United States Patent [19]

Hasebe et al.

[11] Patent Number: 4,865,962

[45] Date of Patent: Sep. 12, 1989

[54] PHOTOGRAPHIC LIGHT-SENSITIVE MATERIAL AND METHOD OF DEVELOPING THE SAME

[75] Inventors: Kazunori Hasebe; Masahiro Asami; Naoto Ohshima; Keisuke Shiba; Toshihiro Nishikawa; Kei Sakanoue; Akira Abe, all of Minami-ashigara, Japan

[73] Assignee: Fuji Photo Film Co., Ltd., Kanagawa, Japan

[21] Appl. No.: 138,162

[22] Filed: Dec. 28, 1987

[30] Foreign Application Priority Data

Dec. 26, 1986 [JP] Japan ..... 61-311131
Apr. 8, 1987 [JP] Japan ..... 62-86252

[51] Int. Cl.[4] ..... G03C 1/02

[52] U.S. Cl. ..... 430/567; 430/569; 430/603; 430/604; 430/605

[58] Field of Search ..... 430/567, 569, 542, 603, 430/604, 605, 570

[56] References Cited

U.S. PATENT DOCUMENTS 2,592,250 4/1952 Davey et al. ..... 430/569
4,035,185 7/1977 Evans et al. ..... 430/567
4,094,684 6/1978 Maskasky ..... 430/567
4,142,900 3/1979 Maskasky ..... 430/567
4,435,501 3/1984 Maskasky ..... 430/567
4,459,353 7/1984 Maskasky ..... 430/567
4,463,087 7/1984 Maskasky ..... 430/567
4,471,050 9/1984 Maskasky ..... 430/567
4,490,458 12/1984 House ..... 430/567
4,496,652 1/1985 Haugh et al. ..... 430/569
4,746,603 5/1988 Yamashita et al. ..... 430/603

*Primary Examiner*—Paul R. Michl
*Assistant Examiner*—Patrick A. Doody
*Attorney, Agent, or Firm*—Sughrue, Mion, Zinn, Macpeak & Seas

[57] ABSTRACT

A photographic light-sensitive material comprising a support having thereon at least one light-sensitive silver halide emulsion layer, characterized in that the emulsion layer contains silver chlorobromide prepared in such a manner that silver halide regular crystal grains, having no twinning crystal plane and containing 50 mol % or more of silver chloride, are used as host grains, an organic compound is adsorbed on a surface of each of the host grains, and sulfur-plus-gold sensitization is performed, either during or after halide conversion in the presence of a bromide.

22 Claims, No Drawings

PHOTOGRAPHIC LIGHT-SENSITIVE MATERIAL AND METHOD OF DEVELOPING THE SAME

BACKGROUND OF THE INVENTION

The present invention relates to a light-sensitive material which has high sensitivity and storage stability, and can be rapidly processed and, more particularly, to a highly sensitive and stable color photographic light-sensitive material which contains a light-sensitive or silver chlorobromide emulsion and in which silver halide is efficiently used.

Color photographic light-sensitive materials are used at present in increasing quantities. Therefore, it is demanded that these materials be developed in a simple method in a short time. At the same time, the quality of the images is required to be both high and uniform. A silver iodobromide emulsion containing 4 to 20 mol % of silver iodide is generally used in a color photographic light-sensitive material, while a silver chlorobromide emulsion is generally used in a color print material. The silver chlorobromide emulsion has lower sensitivity than silver iodobromide emulsion; it cannot easily processed to a high-quality image; and it can serve to achieve rapid color development.

Silver chloride or silver chlorobromide grains, especially, cubic grains having the (100) crystal plane can be processed rapidly and easily, but they cannot readily undergo chemical sensitization or spectral sensitization. The sensitivity of these grains decreases with time, and these grains tend to cause fogging. Several proposals have been made, all with the air of solving these problems. Japanese Patent Application (OPI) No. 48-51,627 and Japanese Patent Publication No. 49-46,932 describe methods in which water-soluble bromide or iodide ions are added after a sensitizing dye has been added to a silver halide emulsion. Japanese Patent Application (OPI) Nos. 58-108,533 and 60-222,845 describe methods in which bromide and silver ions are simultaneously added to silver halide grains having a high silver chloride content, to form layers containing 60 mol % or more of silver bromide on grain surfaces. In a similar proposed method, a layer containing 10 to 50 mol % of silver bromide is formed over all or part of the surface of each grain. In still another method as described in Japanese Patent Publication Nos. 50-36,978 and 58-24,772, U.S. Pat. No. 4,471,050, and West German Patent Application (OLS) No. 3,229,999, bromide ions are added to a silver halide having a high silver chloride content, or else bromide and silver ions are simultaneously added thereto, to convert the halogen, thereby to obtain multiphase grains such as double-structured (i.e., a core and a shell) grains or junction-structured grains. These conventional methods cannot produce color photographic light-sensitive materials which have a satisfactory sensitivity and other satisfactory properties.

A method of chemically sensitizing an emulsion containing much silver chloride is to use sulfur along with a solvent for dissolving silver halide, as described in Japanese Patent Application (OPI) No. 58-30748. According to another chemical sensitization method, as described in Japanese Patent Application (OLS) No. 58-125,612, the pAg and/or temperatures during sensitization by sulfur are controlled in a two-step manner. However, neither of these two methods provides a product having a sufficiently high sensitivity for use as light-sensitive materials for photographing.

Those skilled in the art have thought it necessary to provide a method of easily and quickly processing color photographic light-sensitive materials, which requires a small number of process baths and a small amount of replenisher.

The processing of color negative photographic light-sensitive material consists of a wet process and a drying process continuous thereto. Processing time has been shortened considerably the by introduction of the C-41 process formulated by Eastman Kodak Co, the wet process, however, still takes as long as 17 minutes and 20 seconds to complete. In the case of the rapid process CN-16Q for small laboratories, available from Fuji Photo Film Co., Ltd., processing still takes as long as 9 minutes and 50 seconds.

In order to improve the existing systems of color negative material and color paper to satisfy the users' needs, the development time must be shortened. The present inventors aim at essentially solving this problem. An existing negative film for photographing using a silver iodobromide emulsion maximally utilizes the advantages (e.g., high sensitivity, and an interimage effect) of silver iodide. However, since the film contains silver iodide, the developing time cannot be shortened. More specifically, iodide irons in the desiliverizing solution retards bleaching and fixing of developed silver, inevitably making it impossible to process the materials rapidly or to reduce the replenisher.

The present inventors conducted extensive studies with the object of increasing the sensitivity of a silver chlorobromide emulsion having a high silver chloride content, and to decrease the incidence of reciprocity failure. Optimal combinations of various methods of forming silver halide grains and various chemical sensitization methods were explored in order to attain the present invention.

SUMMARY OF THE INVENTION

It is a first object of the present invention to provide a photographic light-sensitive material having high sensitivity by using a silver halide emulsion of silver chlorobromide suitable for rapid and simple processing, and at the same time stability and uniformity of negative development can be improved.

It is a second object of the present invention to provide a method of developing a photographic light-sensitive material which allows rapid processes including development and fixing.

The above and other objects, features, and advantages of the present invention will be apparent from the description of the following detailed description.

According to the present invention, there is provided a photographic light-sensitive material comprising a support having thereon at least one light-sensitive silver halide emulsion layer, characterized in that the emulsion layer contains silver chlorobromide prepared in such a manner that silver halide regular crystal grains, having no twinning crystal plane and containing 50 mol % or more of silver chloride, are used as host grains, an organic compound is adsorbed on a surface of each of the host grains, and sulfur-plus-gold sensitization is performed, either during or after halide conversion in the presence of a bromide. There is also provided a photographic light-sensitive material wherein 50% or more of all silver halide grains contained in the silver halide emulsion layer comprise silver chlorobromide prepared by halide conversion in the presence of one member selected from the group consisting of silver chlorobromide grains, silver bromide grains, or silver chloroiodobromide grains, these grains having a size smaller than that of the host grains, an organic halide, and a water-soluble bromide.

According to the present invention, there is also provided a method of developing a photographic light-sensitive material, characterized in that the photographic light-sensitive material of claim 1 is desilverized after the material is color-developed.

A silver halide emulsion layer according to the present invention will be described below.

Silver chlorobromide grains contained in the silver halide emulsion layer are regarded as a junction-structure obtained by bonding small guest grains to the host grains, or a structure obtained by partial halide conversion of the host grains. A final halogen composition is determined by the host grains and the conditions of halide conversion. A silver chloroiodobromide containing not less than about 50 mol % of silver chloride and not more than about 2 mol % of silver iodide, and a silver chlorobromide which contains not less than about 50 mol % of silver chloride and does not contain silver iodide are preferable (these materials are referred to as silver chlorobromide hereinafter).

The light-sensitive silver halide emulsion layer containing silver chlorobromide grains according to the present invention contains silver chlorobromide grains the content of which is 50% or more of the total content of silver halide grains in the emulsion layer, and preferably 70% or more, and most preferably 90% or more. A light-sensitive silver halide used together with the silver chlorobromide grains according to the present invention may have any halide composition, any grain size, any crystal habic, and any internal structure. In this case, the light-sensitive silver halide used together with the silver chlorobromide according to the invention is preferably a silver chlorobromide which does not contain silver iodide. In this case, the content of the chloride is preferably 50 mol % or more to effectively obtain the effect of the present invention.

A method of preparing emulsions of the present invention will be described in detail.

(1) Silver Halide Emulsion Layer

1-1. Host Silver Halide Crystal

Host silver halide crystal grains for preparing an emulsion of the present invention are regular crystal gains having no twinning crystal plane. The halide composition of the crystal is defined by a silver bromide, silver chlorobromide, or silver chloride, which contains 2 mol % or less of silver iodide or does not contain silver iodide. The silver halide crystal preferably contains 50 mol % or more, and more preferably at least 90 mol % of silver chloride. The most preferable silver halide is a silver halide containing at least 95 mol % of silver chloride or a pure silver chloride crystal.

The regular crystal grains without having a twinning plane are known to those skilled in the art, as described in "The Theory of the Photographic Process", T. H. James, 4th ed. PP. 21–22, Macmillan, 1977. The regular crystal grain used in the present invention is a cubic or octahedral crystal grain (the corner of such a grain may be rounded and the grain may have planes of higher order) having substantially the (100) crystal plane. Cubic, octahedral, tetradecahedral, and dodecahedral crystal grains are included in regular crystal grains of the invention, which have no twinning crystal plane. Therefore, hexahedral and tabular grains having at least one of (111) crystal plane, (411) crystal plane; (211) crystal plane, and the like as a twinning crystal plane are not included in the regular crystal grains used herein.

The average grain size of the host silver halide grains preferably falls within the range of 0.2 μm to 2 μm, and its size distribution is preferably monodispersed.

A monodisperse emulsion of the host grains according to the present invention is an emulsion having a grain size distribution such that a variation coefficient ($S/\bar{r}$) is 0.25 or less, where $\bar{r}$ is the average grain size and S is the standard deviation of the gain size. More specifically, if the grain size of each emulsion grain is defined as $r_i$ and its number is defined as $n_i$, the average grain size $\bar{r}$ is defined as follows:

$$\bar{r}=(\Sigma n_i r_i)/\Sigma n_i$$

and its standard deviation S is defined below:

$$S=\sqrt{\{\Sigma(\bar{r}-r_i)^2\cdot n_i\}/\Sigma n_i}$$

Each grain size used in the present invention is a corresponding diameter of a projected area when a silver halide emulsion is photographed by a method (normally, photographing with an electron microscope) known to those skilled in the art, as described in "The Theory of the Photographic Process", T. H. James et al., 3rd ed., PP. 36–43, Macmillan (1966). The corresponding diameter of the projected area of the silver halide grain is defined as a diameter of a circle having the same area as the projected area of the silver halide grain. Average grain size $\bar{r}$ and its deviation S of a regular crystal grain of silver halide (e.g., a cubic, octahedral, or tetradecahedral crystal grain) of the present invention, which is not a spherical, can be obtained.

The variation coefficient of the silver halide grain size is 0.25 or less, preferably 0.20 or less, more preferably 0.15 or less, and most preferably 0.01 or less.

1-2. Adsorptive Organic Compound

An organic compound of the present invention is adsorbed to the surface of each host silver halide grain and serves as a halide conversion start restriction agent (to be referred to as a CR compound hereinafter).

A CR compound is generally a material which is selectively adsorbed to a specific crystal, thereby delaying the halide conversion start time of the specific crystal plane as compared with the case wherein the compound is not adsorbed or with other crystal planes or to completely prevent halide conversion of the specific crystal plane. For example, the CR compound is adsorbed to the (100) crystal plane rather than the (111) crystal plane to restrict the start of conversion on the (100) crystal plane.

Examples of the CR compound used in the present invention are mercaptoazoles, and hydrolysis products of nucleic acid. A preferable CR compound is represented by formulae [I], [II], or [III]. Preferable examples of the compound are a simple cyanine dye, a carbocyanine dye or a dicarbocyanine dye represented by formula [I] or [II].

Formula [I]

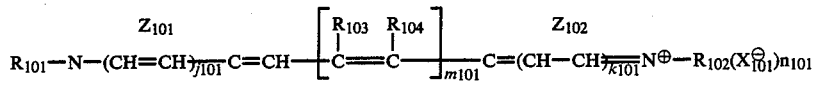

wherein $Z_{101}$ and $Z_{102}$ independently represent an group of atoms required for forming a heterocyclic nucleus.

Examples of the heterocyclic nucleus are preferably 5- and 6-membered cyclic nuclei (a condensation ring may be bonded to these rings or a substituting group may be bonded thereto) containing nitrogen, sulfur, oxygen, selenium, or tellurium as a hetero atom.

Practical examples of the heterocyclic ring nucleus are a thiazole, benzothiazole, naphthothiazole, selenazole, benzoselenazole, naphthoselenazole, oxyazole, benzoxazole, naphthoxazole, imidazole, benzimidazole, naphthimidazole, 4-quinoline, pyrroline, pyridine, tetrazole, indolenine, benzindolenine, indole, tellurazole, benzotellurazole, and naphthotellurazole.

$R_{101}$ and $R_{102}$ independently represent alkyl, alkenyl, alkynyl, or aralkyl. Such a group and groups to be described later mean groups containing their substituents. For example, alkyl groups include substituted and unsubstituted alkyl groups which may be straight-chain, branched, or cyclic groups. The number of carbon atoms of the alkyl is preferably 1 to 8.

Examples of the substituent for the substituted alkyl group are halogen (e.g., chlorine, bromine, and fluorine), cyano, alkoxy, substituted or unsubstituted amino, carboxyl, sulfo, and hydroxyl. These groups may be substituted singly or in a combination of a plurality of groups.

An example of the alkenyl is vinylmethyl.

Examples of aralkyl are benzyl and phenethyl.

$m_{101}$ represents an integer, 1, 2 or 3.

If $m_{101}$ represents 1, $R_{103}$ represents hydrogen, lower alkyl, aralkyl, or aryl. An example of the aryl is substituted or unsubstituted phenyl. $R_{104}$ represents hydrogen. If $m_{101}$ represents 2 or 3, $R_{103}$ represents hydrogen, and $R_{104}$ represents hydrogen, lower alky, or aralkyl. In addition, $R_{104}$ may be bonded to other $R_{104}$ to form a 5- or 6-membered ring. If $m_{101}$ represents 2 or 3 and $R_{104}$ represents hydrogen, then $R_{103}$ may be bonded to another $R_{103}$ to form a hydrocarbon ring or a heterocyclic ring. This ring is preferably a 5- or 6-membered ring.

$j_{101}$ and $k_{101}$ each represent 0 or 1, $X_{101}\ominus$ represents an acid anion, and $n_{101}$ represents 0 or 1.

Formula [II]

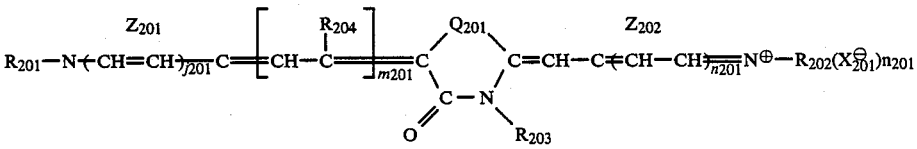

wherein $Z_{201}$ and $Z_{202}$ each have the same meaning as $Z_{101}$ and $Z_{102}$; $R_{201}$ and $R_{202}$ each have the same meaning as $R_{101}$ and $R_{102}$; $R_{103}$ represents alkyl, alkenyl, alkynyl, or aryl (e.g., substituted or unsubstituted phenyl); $m_{201}$ represents 0, 1, or 2; and $R_{204}$ represents hydrogen, lower alkyl, or aryl. If $m_{201}$ represents 2, $R_{204}$ may be bonded to another $R_{204}$ to form hydrocarbon ring or heterocyclic ring. This ring is preferably a 5- or 6-membered ring.

$Q_{201}$ represents sulfur, oxygen, selenium, or $>N\text{-}R_{205}$ wherein $R_{205}$ has the same meaning as $R_{203}$ $j_{201}$, $k_{201}$, $X_{201}\ominus$, $n_{201}$ respectively have the same meanings as $j_{101}$, $k_{101}$, $X_{101}\ominus$, and $n_{101}$.

Formula [III]

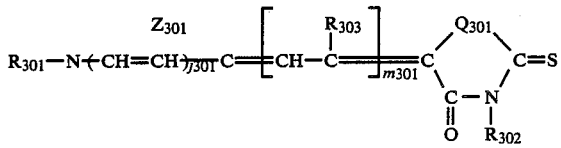

wherein $Z_{301}$ represents an atomic group required for forming heterocyclic ring. Examples of the heterocyclic group are the ones described with reference to $Z_{101}$ and $Z_{102}$, thiozalidine, thiazoline, benzothiazoline, naphthothiazoline, selenazolidine, selenazoline, benzoselenazoline, naphthoselenazoline, benzoxazoline, naphthoxazoline, dihydropyridine, dihydroquinoline, benzimidazoline, and naphthomidazoline. $Q_{301}$ has the same meaning as $Q_{201}$. $R_{301}$ has the same meaning as $R_{101}$ or $R_{102}$ $R_{102}$ has the same meaning as $R_{203}$. $m_{301}$ has the same meaning as $m_{201}$. $R_{303}$ has the same meaning as $R_{204}$. In addition, if $m_{301}$ represents 2 or 3, $R_{303}$ may be bonded to another $R_{303}$ to form a hydrocarbon ring or heterocyclic ring. $j_{301}$ has the same meaning as $j_{101}$.

CR compounds represented by formula [I], [II], or [III] are summarized in Table 8 but are not limited thereto.

1-3. Halide Conversion

"Halide conversion" is referred to as halide conversion in a broad sense unless otherwise indicated.

A CR compound is adsorbed to the host silver halide grains to perform halogen conversion using silver halide micrograins, thereby controlling a development start point at corners or a position near the corners.

The following point is very important in the present invention. If a concentration of bromide ions used for conversion is excessively high, conversion abruptly progresses. As a result, the function of the CR compound of the invention is relatively degraded.

It is preferable to slowly supply bromide ions at a relatively low concentration. Halide conversion is started at the corners or the vicinity of the corners in the presence of the CR compound.

Various types of bromides may be used to supply halide ions required for halide conversion. For example, a water-soluble bromide such as potassium bromide may be used. However, a preferable bromide is the one which allows control of the supplying amount of bromide ions and the supplying rate. Examples of the preferable bromide are an organic halogen compound, an inorganic halogen compound having an appropriate water solubility, and a halogen compound covered with a capsule membrane or semipermeable membrane. Preferably, the size of the silver chlorobromide, silver chloroiodobromide, or silver bromide grains is finer than the host grain size. In practice, a preferable silver halide has a grain size finer than that of the host grain and a higher content of silver bromide than that of the host silver halide. For example, an emulsion, which contains silver chlorobromide or silver bromide in an amount corresponding to 0.1 to 7 mol % (e.g., above 1 mol %) of host silver chloride, and have an average grain size of about 0.05 to 0.1 μm (e.g., about 0.1 μm), is mixed with an emulsion containing host silver chloride grains adsorbed with the CR compound to cause halide conversion. During conversion and ripening, the silver chlorobromide or silver bromide grains are dissolved and disappear. When the reaction reaches an equilibrium state, a layer of new halide composition is formed on the corners of each host grain, and the reaction is interrupted.

In this manner, halide conversion of the present invention progresses such that a silver halide phase having a higher silver bromide content is precipitated on each host silver halide grain surface. There are two bromide ion supply sources, i.e., a water-soluble bromide and higher silver bromide micrograins.

The former process propagates by exchange reaction between halide ions on the host silver halide grain surfaces and supplied bromide ions, and can be called "halide conversion in a narrow sense."

The latter process propagates by a process of forming a crystal having a stabler composition between the host silver halide grains and the higher silver bromide micrograins, and can be called "recrystallization". In the recrystallization reaction, the driving force of the reaction is an increase in entropy, and is quite different from Ostwald ripening. This is described in, i.e., "Journal of American Chemical Society 59 P. 916 (1973)" by H. C. Yutzy.

To our surprise, these quite different reactions select a portion near the peak of the host grain as a formation place of a new phase having a higher silver bromide content. In any case, since the new phase having a higher silver bromide content can be formed, the present invention describes both the halide conversion in a narrow sense and the recrystallization as halide conversion in a broad sense.

In order to effectively achieve the object of the present invention to obtain very high sensitivity such that latent image nuclei or development centers are localized, a compound (CR compound) for suppressing or preventing start of halide conversion can be used.

The CR compound can improve selectivity of the first formation place of the new phase having a higher silver bromide content than the host grains, can prevent a reaction wherein the first formed new phase is repetitively recrystallized with the surfaces of the host grain to convert the entire surface of the host grain as a new uniform layer, and can promote to form an carry the "new phase having a higher silver bromide content" which is grown by epitaxial bond at a restricted portion near the corners of the host grain. To our surprise, formation of the new phase restricted by this place can achieve very high sensitivity as the object of the present invention.

A halide conversion method in a narrow sense for supplying the bromide ions can readily form a phase having a high silver bromide content. Therefore, pressure desensitizing properties are easily degraded. In addition, since a reaction rate is too high, variations in conversion between emulsion grains easily occur. Especially, this poses a problem in large-scale production on the commercial purpose. In a method of mixing and ripening fine grains and host grains, since the recrystallization reaction propagates slower than the halide conversion reaction in a narrow sense, uniformity of the reaction is high and the reaction can be easily controlled. Furthermore, in the method of mixing and ripening fine grains and host grains, the silver bromide content of the new phase can be adjusted within a wider range in accordance with the silver bromide content or the grain size of higher silver bromide micrograins or chloride ion concentration in the recrystallization reaction.

Each silver halide grain of the present invention contains 90 mol % or more of silver chloride, and a new phase having a larger silver bromide content than the host grain is epitaxially grown near the corners of the host grains. Thus, the grain in some cases has a moderate transition area of a halide composition between the new phase and the host grain.

The structure of the grain is observed by various analytical techniques. First, it can be revealed using an electron microscope that a new phase is bonded near the corners of the grain in accordance with a change in form of the grain.

By an X-ray diffraction method, a halide composition between the host grain and the new phase can be revealed.

An average halide composition of a surface can be determined using an ESCA 750 spectroscope available from Shimazu-du Pont Corp. by an XPS (X-ray Photoelectron Spectroscopy) method. This measurement is described in "Surface Analysis" by Someno & Yasumori, Kodansha (published in 1977).

The X-ray diffraction method can reveal the halide composition between the host grain and the new phase, and the XPS can reveal the average silver halide composition of the surface. Therefore, an approximate ratio of the area of the new phase having a larger silver bromide content than the host grain to the area of the entire surface can be obtained.

In order to specify the position of the new phase having a higher silver bromide content than the host grain or to measure the ratio of the new phase to a portion near the corners of the grain, and EDX (Energy Dispersive X-ray analysis) method can be performed using an EDX spectrometer equipped in a transmission electron microscope as well as the observation using the electron microscope. This measurement method is described in detail in "Electron Microanalysis" by Hiroyoshi Fukushima, Nikkan Kogyo Shinbunsha (published in 1987).

The new phase of the present invention is preferably localized near the corners of the host grain. The average halide composition of the surface preferably contains 15 mol % or less of silver bromide, and more preferably, 10 mol % or less. An increase in average silver bromide content of the surface means a decrease in degree of localization of the new phase near the corners, and at the same time, causes a decrease in sensitivity.

In the new phase formed by the preferably fabrication method according to the present invention, it was observed that the phase was epitaxially bonded and grown on corners of the host grain.

The emulsion of the present invention has very high sensitivity since the latent image nuclei or the development is localized. Further, stability can be greatly improved and fogging can be prevented without preventing rapid development. Surprisingly, an emulsion of hard gradation can be obtained. In addition, the resultant emulsion has high resistance to pressure, thus advantageously preventing desensitizing by pressure and fogging in a nonexposed portion.

The CR compound according to the present invention can be selected from sensitizing dyes. In particular, the CR compound for the (100) crystal plane can be selected from the compounds represented by formulas [I], [II] and [III] and can also serve as a sensitizing dye. Therefore, spectral sensitivity can be improved, and in addition halide conversion can further stabilize the spectral sensitivity. An excellent combination of silver halide and chemical sensitization method thereof and its effect are remarkable findings.

In order to improve sensitivity and stability, the CR compounds can be combined with another sensitizing dye or a super sensitizing agent.

The photographic light-sensitive material may contain an aminostilbenzene compound substituted by a nitrogen-containing heterocyclic nucleic group (a compound represented by formula (I) described in a specification of Japanese Patent Application No. 61-231,498 filed on Sept. 30, 1986 by Fuji Photo Film Co., Ltd., and particularly, compounds (I-1) to (I-17) therein and the ones described in U.S. Pat. Nos. 2,933,390 and 3,635,721), an aromatic organic acid formaldehyde condensation product (e.g., a compound described in U.S. Pat. No. 3,743,510), a cadmium salt, and an azaindene compound. Combinations described in U.S. Pat. Nos. 3,615,613, 3,615,641, 3,617,295, and 3,635,721 are very useful.

The silver halide emulsion containing host grains according to the present invention is prepared while its pH, and the time for adding silver nitrate and halogenated alkali are controlled. The pH for forming the host silver halide grains according to the present invention preferably falls within the range of 2 to 10.

The CR compound in the present invention may be added any time before halide conversion, and preferably during the second half period of formation of host grains or immediately after their formation.

A method of adding a CR compound will be described below.

The CR compound is dissolved in a water-miscible organic solvent, such as alcohol (e.g., methanol) or ethyl acetate, and the resultant solution is then added to the emulsion of host silver halide. The CR compound may be added such that it is dispersed in an aqueous solution of gelatin or surfactant. The content of the CR compound is preferably $10^{-5}$ to $10^{-2}$ mol % per mol of the host silver halide, and more preferably $10^{-5}$ to $10^{-3}$ mol %. Use of the CR compound having a covering percentage of 30 to 100% and preferably 40 to 80% is preferred. The fine grains of above-mentioned silver halide are added to the resultant emulsion, and the mixture is ripened at 30° to 80° C. while pAg is controlled to fall within the range of 5 to 10, thereby completing halide conversion.

Thereafter, a sensitizing dye or a supersensitizer is added as needed to improve spectral sensitization.

During or after halide conversion, the following chemical sensitization of silver halide is preferably performed.

1-4. Chemical Sensitization

Chemical sensitization in the present invention is performed during or after halide conversion, i.e., while halide conversion is being performed or after halide conversion is completed.

Conventional chemical sensitization techniques use sensitization by sulfur selenium, reducing agent or a noble metal. These materials are used singly or in a combination. The characteristic feature of the present invention is a combination of the sulfur and gold sensitizers. Conventional sensitization by sulfur as one of the chemical sensitization techniques for an emulsion having a high silver chloride content is described in Japanese Patent Application (OPI) Nos. 58-30,748 and 58-125,612. However, sensitization by gold is not specifically described in the prior art, except the general description indicating that gold sensitization can be performed. The above description results from the following reasons. First, it is very difficult to obtain high sensitivity of an emulsion having the (100) crystal plane and a high silver chloride content by using a normal sulfur sensitizer. Second, it is very difficult to perform sensitization of an emulsion having a high silver chloride content by using a normal gold sensitizer. The present inventors made extensive studies on these sensitization techniques and found that a highly sensitive emulsion having a high silver chloride content could be obtained by performing sulfur-plus-gold sensitization the emulsion halogen-converted as described above.

A chemical sensitization methods which can be used are a gold sensitization method using a gold compound (e.g., U.S. Pat. Nos. 2,448,060 and 3,320,069), a sensitization method using a metal such as iridium, platinum, rhodium, or palladium (e.g., U.S. Pat. Nos. 2,448,060, 2,566,245, and 2,566,263), a sulfur sensitization method using a sulfur-containing compound (e.g., U.S. Pat. No. 2,222,264), a selenium sensitization method using a selenium compound, a reduction sensitization method using stannates, thiourea dioxide, or polyamine (e.g., U.S. Pat. Nos. 2,487,850, 2,518,698, and 2,521,925), or a combination of at least two methods described above.

The sulfur-plus-gold sensitization method is very effective in combination with the host grains in the present invention.

The amount of the gold sensitizer is preferably $5\times10^{-6}$ mol or more per mol of silver halide, and more preferably $1.5\times10^{-5}$ mol to $1\times10^{-3}$ mol. The amount of the sulfur sensitizer used together with the gold sensitizer can be properly selected according to conditions such as a grain size, a chemical sensitization temperature, pAg, and pH and is $10^{-7}$ to $10^{-3}$ mol per one mol of silver halide, preferably $5\times10^{-7}$ to $10^{-4}$ mol, and more preferably $5\times10^{-7}$ to $10^{-5}$ mol.

Typical examples of the gold sensitizer are chloroauric acid and chloroaurates. The gold sensitizer can be used together with thiocyanate to improve sensitivity, as described on P. 155 of the above-mentioned reference written by James et al.

Examples of the sulfur sensitizer used together with the gold sensitizer in the present invention are thioureas (e.g., sodium thiosulfate, and tetramethyl thiourea) and a rhodanine compound.

The sulfur-plus-gold sensitization is preferably performed when the halide conversion has progressed 50% or more. More preferably, such sensitization is performed when halogen conversion is almost finished. The progress of halogen conversion can be traced by an ESCA (or XPS) method.

Use of a tetrazaindene antifogging agent is preferable. When this antifogging agent is used in the silver chlorobromide emulsion of the present invention, a sensitization effect in addition to the antifogging effect can be obtained. The antifogging agent is added to the silver chlorobromide emulsion before the resultant emulsion is applied to a film after the chemical sensitization process. The content of the antifogging agent is $10^{-4}$ to $10^{-2}$ mol per mol of silver chlorobromide of the present invention. A typical example of the antifogging agent is 4-hydroxy-6-methyl(1,3,3a,7)-tetrazaindene.

(2) Photographic Light-Sensitive Material 2-1. Amount of Silver Applied to Support An amount of silver of the photographic light-sensitive material applied to a transparent support is about 3 to 10 $gm^2$, preferably 3 to 7 $g/m^2$, and more preferably 3 to 5 $g/m^2$. When the amount of silver halide applied to the support is small, rapid color development and rapid desilvering can be performed.

2-2. Color Coupler

In the this invention various color couplers can be used. Specific examples of these couplers are described in patents in *Research Disclosure* (RD) No. 17643, II-C to II-G. As dye forming couplers, couplers giving these primary colors of subtractive color process (i.e., yellow, magenta, and cyan) by color development are typically important. Specific examples of nondiffusing couplers, four-equivalent couplers, and two-equivalent couplers are described in patents referred *Research Disclosure* (RD) No. 17,643, VII-C and VII-D and further the following couplers can be preferably used in the present invention.

A typical yellow couplers which can be used in the present invention include a hydrophobic acylacetamide series couplers having a ballast group. Specific examples of the yellow coupler are described in U.S. Pat. Nos. 2,407,210, 2,875,057, and 3,265,506. In the present invention a two-equivalent yellow coupler is preferably used. Typical examples thereof are the oxygen atom-releasing type yellow couplers described in U.S. Pat. Nos. 3,408,194, 3,447,928, 3,933,501, 4,022,620, 4,157,919, and 4,401,752, and Japanese Patent Application (OPI) Nos. 59-174,839 and 59-214,854; and the nitrogen atom-releasing type yellow couplers described in Japanese Patent Publication No. 58-10739, U.S. Pat. Nos. 4,146,396 and 4,326,024, *Research Disclosure* No. 18053 (April, 1979), British Pat. No. 1,425,020, West German Patent Application (OLS) Nos. 2,219,917, 2,261,316, 2,329,587, and 2,433,812. The α-pivaloylacetanilide series couplers are excellent in fastness, in particular light fastness of the colored dye. On the other hand, α-benzoylacetanilide series couplers show high color density.

Typical magenta couplers which can used in this invention include hydrophobic indazolone type or cyanoacetyl series, preferably 5-pyrazolone type and pyrazoloazole series couplers each having a ballast group. In the 5-pyrazolone series couplers, the 3-position is preferably substituted by an arylamino or acylamino in the viewpoint of the hue and coloring density of the colored dye. Specific examples of such couplers are described in U.S. Pat. Nos. 2,311,082, 2,343,703, 2,600,788, 2,908,573, 3,062,653, 3,152,896, and 3,936,015. As the reliable group of a two-equivalent 5-pyrazolone type coupler, a nitrogen atom releasing group described in U.S. Pat. No. 4,310,619 and an aryl thio group described in U.S. Pat. No. 4,351,897 are particularly greffed. Also, the 5-pyrazolone type couplers having a ballast group described in European Pat. No. 73,636 give high coloring density. As the pyrazoloazole type magenta couplers, there are pyrazolobenzimidazoles described in U.S. Pat. No. 3,061,432, preferably pyrazolo[5,1-c][1,2,4]triazoles described in U.S. Pat. No. 3,725,067, pyrazolotetrazoles described in *Research Disclosure* No. 24220 (June, 1984) and Japanese Patent Application (OPI) No. 60-33,552, and pyrazolopyrazoles described in *Research Disclosure* No. 24230 (June, 1984) and Japanese Patent Application (OPI) No. 60-43,659. Imidazo[1,2-b]pyrazoles described in U.S. Pat. No. 4,500,630 is preferable in favor of less side yellow absorption and light-fastness of the colored dye, and particularly pyrazolo[1,5-b][1,2,4]triazole described in U.S. Pat. No. 4,540,654 is preferable.

Typical examples of cyan couplers which can be used in the present invention include hydrophobic and non-diffusible naphtholic and phenolic couplers. Typical examples of the cyan couplers are a naphtholic couplers described in U.S. Pat. No. 2,474,293, and preferably oxygen atom-releasing type two-equivalent naphtholic couplers described in U.S. Pat. Nos. 4,052,212, 4,146,396, 4,228,233, and 4,296,200. Also, specific examples of the phenolic coupler are described in U.S. Pat. Nos. 2,369,929, 2,801,171, 2,772,162, and 2,895,826.

A coupler capable of forming a cyan dye which is excellent in humidity-fastness and heat-fastness can be preferably used in the present invention. Specific examples of such cyan couplers are: a phenolic cyan coupler having an alkyl group with carbon atoms the number of which is equal to or higher than that of the ethyl group, the alkyl group being located at the metaposition of the phenol nucleus, described in U.S. Pat. No. 3,772,002; 2,5-diacylamino substituted phenolic couplers described in U.S. Pat. Nos. 2,772,162, 3,758,308, 4,124,396, 4,334,011, and 4,327,173, West German Patent Application (OLS) No. 3,329,729, and European Pat. No. 121,365; and phenolic couplers having a phenylureido group at the 2-position thereof and an acylamino group at the 5-position thereof described in U.S. Pat. Nos. 3,446,622, 4,333,999, 4,451,559, and 4,427,767. A cyan coupler substituted by sulfonamido or amido at the 5-position of naphthol, described in European Pat. No. 161,626A provides a color image which is excellent in light-fastness of colored dye and can be preferably used in the present invention.

2-3. Functional Coupler

In order to correct additional, undesirable absorption of colored dye, it is preferred to perform color masking by using colored couplers together in the case of color photographic materials in-camera use. Specific examples of these colored couplers are the yellow-colored magenta couplers described in U.S. Pat. No. 4,163,670 and Japanese Patent Publication No. 57-39,413, and the magenta-colored cyan couplers described in U.S. Pat. Nos. 4,004,929 and 4,138,258, and British Pat. No. 1,146,368. Other colored couplers which can be used in this invention are described in above described *Research Disclosure* No. 17643, VII-G.

A masking agent having in its releasable group a legend capable of forming a chelate dye, as described in U.S. Pat. Nos. 4,553,477, 4,555,478, 4,557,998, and 4,568,633, can be preferably used in the present invention.

Couplers capable of forming colored dyes having proper diffusibility can be used to improve graininess, in this invention. As such couplers, specific examples of magneta couplers are described in U.S. Pat. No. 4,336,237 and British Pat. No. 2,125,570, and specific examples of yellow couplers, magenta couplers, and cyan couplers are described in European Pat. No. 96,570 and West German Patent Application (OLS) No. 3,234,533.

The dye-forming couplers and the special couplers described above each may be polymers (dimers or higher polymers). Typical examples of the polymerized dye-forming couplers are described in U.S. Pat. Nos. 3,451,820, 4,080,211, and 4,455,366. Also, specific examples of the polymerized magenta couplers are described in British Pat. No. 2,102,173, and U.S. Pat. Nos. 4,367,282 and 3,926,436. Water-soluble polymer couplers described in Japanese Patent Application (OPI) Nos. 60-218646 and 58-28744 and U.S. Pat. Nos. 4,207,109 and 4,215,195 are preferably used in the present invention.

Couplers releasing a photographically useful residue upon coupling are preferably used in the present invention. DIR couplers, i.e., couplers releasing development inhibitor, as described in above-described *Research Disclosure* No. 17643, VII-F, is useful. The DIR coupler releasing a development inhibitor is useful from the viewpoint of color reproducibility of the image, but is not desirable from the viewpoint of development and particularly rapid desilvering. It is preferable not to use the DIR coupler in the photographic light-sensitive material.

Preferred examples of these couplers which can be used in the present invention are the developer inactivating type couplers described in Japanese Patent Application (OPI) No. 57-151,944, the timing type couplers described in U.S. Pat. No. 4,248,962 and Japanese Patent Application (OPI) No. 57-154,234, and the reaction type DIR coupler described in Japanese Patent Application (OPI) No. 60-184248. Particularly preferred examples of these couplers are the development inactivating type DIR couplers described in Japanese Patent Application (OPI) Nos. 57-151,944, 58-217,932, 60-218,644, 60-225,156, and 60-2,333,650, and the reaction type DIR couplers described in Japanese Patent Application No. 59-39,653.

Couplers imagewise releasing a nucleating agent, a development accelerator, or a precursors thereof at development can be used in the photographic light-sensitive material of the present invention. Specific examples of these couplers are described in British Pat. Nos. 2,097,140 and 2,131,188. Also, couplers releasing a nucleating agent having an adsorptive acting for silver halide are particularly preferable, and specific examples thereof are described in Japanese Patent Application (OPI) Nos. 59-157,638 and 59-170,840.

Other couplers which can be used in the photographic light-sensitive material of the present invention are a competitive coupler (e.g., a coupler described in U.S. Pat. No. 4,130,427), multi-equivalent couplers (e.g., couplers described in U.S. Pat. Nos. 4,238,472, 4,338,393, and 4,310,618), coupler releasing a DIR redox compound (e.g., a coupler described in Japanese Patent Application (OPI) No. 60-185,950), and a coupler releasing a dye which turned a colored form after being released (e.g., a coupler described in European Pat. No. 173,302A).

Furthermore, couplers releasing bleach accelerator described in Japanese Patent Application (OPI) No. 61-201,247, *Research Disclosure* Nos. 11,449 (October, 1973) and 24,241 (June, 1984) are preferably used to accelerate desilvering.

2-4. Additives

Typical scavengers of the oxidation product of a developing agent which can be used in the present invention are preferably known hydroquinone derivatives, and compounds described in U.S. Pat. No. 4,474,874, Japanese Patent Application (OPI) No. 59-5,247, and U.S. Pat. Nos. 4,525,451, 4,584,264, and 4,447,523.

In addition to use of the DIR coupler for improving sharpness, an unsharp mask method is often used, as described in French Pat. No. 2,260,124 and Japanese Patent Application (OPI) Nos. 61-201,246 and 61-169,843.

2-5. Dispersion Method

The coupler used in the present invention can be introduced according to various known dispersion methods such as a solid dispersion method and an alkali dispersion method, preferably a latex method, and more preferably an oil-in-water dispersion method. According to the oil-in-water dispersion method, a coupler is dissolved in a high boiling organic solvent having a boiling point of 175° C. or more, an auxiliary solvent having a low boiling point, or a mixture thereof and is dispersed in water or an aqueous solution (e.g., an aqueous solution of gelatin) in the presence of a surfactant. Typical high boiling organic solvents are described in U.S. Pat. No. 2,322,027 and the like. Dispersion may accompany phase transition. The auxiliary solvent may be eliminated or reduced by distillation, noodle water-washing or ultrafiltration, and the resultant solvent is used for application.

The process, effect of the latex dispersion method and typical loadable latexes are described in U.S. Pat. No. 4,199,363, and West German Patent Application (OLS) Nos. 2,541,274 and 2,541,230.

2-6. Layer Structure and ISO Sensitivity

The photographic material according to the present invention is preferably used as a national color photographic light-sensitive material. For this purpose, silver halide is combined with couplers for providing complementary colors of color sensitivity of the silver halide. At least one blue sensitive silver halide emulsion layer containing a yellow coupler, at least one green-sensitive silver halide emulsion layer containing a magenta coupler, and at least one red sensitive silver halide emulsion layer containing a cyan coupler are formed on a transparent support to prepare a light-sensitive material for photographing. The "for photographing" indicates for a film loaded in a portable camera and used.

The present invention is preferably applied to a light-sensitive material loaded and used in a portable camera, i.e., a photographic light-sensitive material used for photographing. For this purpose, the photographic light-sensitive material is preferably a photographic light-sensitive material having at least two light-sensitive silver halide emulsion layers having identical color sensitivity but different speed in order to obtain sufficient exposure latitude and improve desired photographic characteristics such as speed and sharpness.

The present invention can provide a high speed negative type color photographic light-sensitive material for photographing, having the ISO sensitivity range of 25 to 3,200. The photographic light-sensitive material for photographing prepared by the present invention substantially does not contain silver iodide as in a silver halide used in conventional color paper and is suitable for simultaneous process for negative type and paper.

(3) Development Process 3-1. Color Developer

A color developer used in development of the photographic light-sensitive material according to the present invention is an alkaline aqueous solution containing an aromatic primary amine type color developing agent as a primary component. An aminophenol compound can be effectively used as an aromatic primary amine color developing agent. However, a p-phenylenediamine type compound is more suitable as the color developing agent, and its examples are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, and 3-methyl-4-amino-N-ethyl-N-β-methoxyethylaniline; and sulfates, chlorates, phosphates, p-toluenesulfonates, tetraphenylborates, and p-(t-octyl)benzensulfonates of these compounds.

3-2. N-Hydroxyalkyl Substituted p-Phenylenediamine Derivatives

To simplify the development process and perform it at high speed, the developing agent must a high developing rate and small variations in development activation during replenishment with respect to the photographic light-sensitive material of the present invention. A typical example of the preferable developing agent is 3-methyl-4-amino-N-ethyl-N-β-hydroxyethylaniline represented by formula (IV), wherein $R_1$ is hydrogen or alkyl (preferably the number of carbon atoms is 1 to 6); $R_2$ represents $-(R_4)m-(R_5)n-R_6$, wherein $R_4$ and $R_5$ represent the same or different alkylene groups (preferably the number of carbon atoms is 1 to 4), m and n independently represent an integer, 0 to 4, but m and n do not represent simultaneously 0, and $R_6$ represents hydrogen, aryl (preferably the number of carbon atoms is 6 to 8), or alkyl (preferably the number of carbon atoms is 1 to 6); and $R_3$ represents hydrogen, halogen, alkylsulfonamido, acylamido, or amino.

The number of carbon atoms contained in $R_3$ is preferably 1 to 4.

$R_1$, $R_2$, and $R_3$ of compounds represented by formula (IV) are summarized in Table 1.

TABLE 1

Formula (IV)

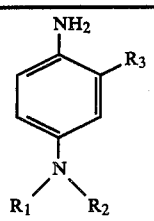

| Compound No. | $R_1$ | $R_2$ | $R_3$ |
|---|---|---|---|
| 1 | $-C_2H_5$ | $-C_2H_4OH$ | $-CH_3$ |
| 2 | $-C_2H_5$ | $-C_3H_6OH$ | $-CH_3$ |
| 3 | $-C_2H_5$ | $-C_2H_4OH$ | $-H$ |
| 4 | $-CH_3$ | $-C_2H_4OH$ | $-CH_3$ |
| 5 | $-C_3H_7$ | $-C_2H_4OH$ | $-CH_3$ |
| 6 | $-CH_3$ | $-C_2H_4OCH_3$ | $-CH_3$ |
| 7 | $-C_2H_5$ | $-C_2H_4OCH_3$ | $-CH_3$ |
| 8 | $-CH_3$ | $-CH(CH_3)CH_2OCH_3$ | $-CH_2CH_2OCH_3$ |
| 9 | $-C_2H_5$ | $-C_2H_4OC_2H_5$ | $-CH_3$ |
| 10 | $-(n)-C_4H_9$ | $-C_2H_4OH$ | $-CH_3$ |

The content of the color developing agent is 1 g to 30 g per liter of the color developing solution and is preferably 3 to 10 g.

The color developing agents of compounds represented by formula (Iv) are frequency used singly. However, color developing agents represented by the given formula or different formulas may be mixed. Examples of such mixtures are: a mixture of 3-methyl-4-amino-N-ethyl-N-β-hydroxyethylaniline and 3-ethyl-4-amino-N-β-methanesulfonamideethylaniline; and a mixture of 3-methyl-4-amino-N-ethyl-N-β-methoxyethylaniline 5 and 3-methyl-4-amino-N-ethyl-N-β-methanesulfonamidoethylaniline.

3-3. Additives for Color Developer

The color developing solution may contain: a pH buffering agent such as carbonate, borate, or phosphate of alkali metal; a developing inhibitors or antifogging agents such as chloride, bromide, iodide, benzimidazole, benzothiazole, or mercapto compound; preservatives such as hydroxylamine, diethylhydroxylamine, triethanolamine, the compounds described in West German Patent Application (OLS) No. 2,622,950, a compound described in Japanese Patent Application No. 61-265,149, sulfite, or bisulfite; an organic solvents such as diethylene glycol; a development accelerator such as benzyl alcohol, polyethylene glycol, quaternary ammonium salt, amines, thiocyanate, 3,6-thioctane-1, 8-diol; competitive couplers; auxiliary developing agents such as 1-phenyl-3-pyrazolidone; thickfiers; and a chelate agent such as ethylenediamine tetraacetatic acid, nitrylotriacetic acid, cyclohexadiamine tetraacetatic acid, iminodiacetatic acid, hydroxyethyliminodiacetatic acid, N-hydroxymethylethylenediaminetriacetatic acid diethylenetriaminepentacetatic acid, triethylenetetraminehexacetatic acid, the compounds described in Japanese Patent Application (OPI) No. 58-195845, 1-hydroxyethylidene-1, 1'-diphosphonic acid, an organic phosphonic acid described in *Research Disclosure* No. 18,170 (May, 1979), an aminophosphonic acids (e.g., aminotris(methylene phosphonic acid) ethylenediamine-N,N,N',N'-tetramethylenephosphonic acid, and phosphonocarboxylic acids described in Japanese Patent Application (OPI) Nos. 52-102,726, 53-42,730, 54-121,127, 55-4,024, 55-4,025, 55-126,241, 55-65,955, and 55-65,956, and *Research Disclosure* No. 18,710 (May, 1979).

The pH of the color developer falls within the range of 8 to 13, preferably 9 to 12, and most preferably 9.5 to 11.5. The process temperature in the present invention falls within the range of 25° to 50° C., preferably 30° to 50° C., and particularly preferably 35° to 45° C. in favor of rapid development.

For processing the photographic light-sensitive material of the present invention, the developer developer preferably contains $1\times10^{-3}$ mol/l to $2\times10^{-1}$ /l of a water-soluble chloride, and preferably $5\times10^{-3}$ mol/l to $5\times10^{-2}$ mol/l thereof. Preferable examples of the water-soluble chloride are potassium chloride and sodium chloride.

In case of continuous process of the photographic light-sensitive material, according to the present invention, the color developer can be continuously replenished. An amount of replenishment is preferably 1 to 10 ml/100 $cm^2$ of the photographic light-sensitive material of this invention. In addition, in order to prevent fogging, the developer preferably contains $3\times10^{-2}$ mol/l of a water-soluble bromide. Preferable water-soluble bromides are potassium bromide and sodium bromide.

It is preferable to use a color developer which substantially does not contain iodide ions. The expression "substantially does not contain" means that an amount of iodide ions is 1.0 mg/l or less.

According to the present invention, the color developer does not preferably contain a sulfite as long as the developer is not oxidized and can be properly preserved. The content of an anhydrous sulfurous acid is preferably 4 g or less per liter, preferably 2 g or less, and most preferably 1 g or less, thereby improving coloring density of the colored dye.

A time of development by the color developer is 10 seconds to 3 minutes and 30 seconds, preferably 10 seconds to 2 minutes, and most preferably 20 seconds to one minute and 30 seconds.

3-4. Desilvering

The photographic light-sensitive material of the present invention is desilvered after color development is performed. Desilvering can be performed by one of the following methods (i) a method using a bleaching solution bath and a fixing solution bath; (ii) a method using a bleaching solution bath and a bleach-fixing solution bath as described in Japanese Patent Application (OPI) No. 61-75,352; (iii) a method using a fixing solution bath and a bleach-fixing solution bath as described in Japanese Patent Application (OPI No. 61-51,143; and (iv) a method using a single bleach-fixing solution bath. The photographic light-sensitive material is preferably processed by one or a plurality of bleach-fixing solution baths in order to shorten the process time.

Examples of the bleaching agent used in a bleach solution or a bleach-fixing solution are a ferric salt, persulfate, dichromate, bromate, red prussiate, and salt of aminopolycarboxylic acid ferric complex. A salt of aminopolycarboxylic acid ferric complex is preferably used in the photographic light-sensitive material of the present invention.

Preferable salts of aminopolycarboxylic acid ferric complex are listed below:

(1) salt of ethylenediaminetetraacetic acid ferric complex;

(2) salt of diethylenetriaminepentaacetic acid ferric complex;

(3) salt of cyclohexanediaminetetraacetic acid ferric complex;

(4) salt of iminodiacetic acid ferric complex;

(5) salt of methyliminodiacetic acid ferric complex;

(6) salt of 1,3-diaminopropanetetraacetic acid ferric complex;

(7) salt of glycoletherdiaminetetraacetic acid ferric complex.

These salts of aminopolycarboxylic acid ferric complex are used in the form of a sodium salt, potassium salt, or ammonium salt, and preferably in the form of an ammonium salt.

The content of the salt of aminopolycarboxylic acid ferric complex in bleaching solution and bleach-fixing solution is 0.05 to 1 mol/l, preferably 0.1 to 1 mol/l, and more preferably 0.1 to 0.5 mol/l.

An accelerator for breaching is used, if necessary, in a bleaching solution or a bleach-fixing solution. Specific examples of the useful accelerator for breaching are: compounds containing mercapto or disulfido groups, as described in U.S. Pat. No. 3,893,858, Germany Patent Publication Nos. 1,290,812 and 2,059,988, Japanese Patent Application (OPI) Nos. 53-32,736, 53-57,831, 53-37,417, 53-65,732, 53-72,623, 53-956,30, 53-95,631, 53-104,232, 53-124,424, 53-141,623, and 53-28,426, and *Research Disclosure* No. 1,729 (July, 1978); thiazolidine derivatives described in Japanese Patent Application (OPI) No. 50-140,129; thiourea derivatives described in Japanese Patent Publication No. 45-8,506, Japanese Patent Application (OPI) Nos. 52-20,832 and 53-32,735, and U.S. Pat. No. 3,706,561; iodides described in Germany Patent Publication No. 1,127,715 and Japanese Patent Application (OPI) No. 58-16,235; polyethylene oxides described in Germany Patent Publication Nos. 966,410 and 2,748,430; polyamine compounds described in Japanese Patent Publication No. 45-8,836; compounds described in Japanese Patent Application (OPI) Nos. 49-42,434, 49-59,644, 53-94,927, 54-35,727, 55-26,506, and 58-163,940; and iodide and bromide ions. Of these bleaching accelerators, the compound having a mercapto or disulfido group is preferable due to an excellent acceleration effect. Particularly the compounds described in U.S. Pat. No. 3,893,858, Germany Patent Publication No. 1,290,812, and Japanese Patent Application (OPI) No. 53-95,630 are preferable.

The bleaching solution or the bleach-fixing solution can contain rehalogenation agents such as a bromides (e.g., potassium bromide, sodium bromide, and ammonium bromide), chlorides (e.g., potassium chloride, sodium chloride, and ammonium chloride), and iodides (e.g., ammonium iodide). Further, the breaching solution or the bleach-fixing solution contain, if necessary, one or more of inorganic and organic acids alkali metal or ammonium salts thereof and, having pH bolfering function, such as boric acid, borax, sodium methabrate, acetic acid, sodium acetate, sodium carbonate, potassium carbonate, phosphorous acid, phosphoric acid, sodium phosphate, citric acid, sodium citrate, and tartaric acid, or corrosion inhibitor such as ammonium nitrate and guanidine.

A fixing agent used in a bleach-fixing solution or fixing solution is a known fixing agent. Examples of the known fixing agent are water-soluble solvents for silver halide such as: a thiosulfate (e.g., sodium thiosulfate or ammonium thiosulfate); a thiocyanate (e.g., sodium thiocyanate or ammonium thiocyanate); a thioether compound (e.g., ethylenebisthioglycolic acid or 3,6-dithia-1,8-octanediole); and a thiourea. These fixing agents can be used singly or in a combination of at least two agents. The thiosulfate, particularly, ammonium thiosulfate, is preferably used in the present invention.

The content of the fixing agent per liter is preferably 0.3 to 2 mol and more preferably 0.8 to 1.5 mol.

The pH range of the bleach-fixing or fixing solution is preferably 3 to 10 and more preferably 5 to 9. When the pH of the solution is lower than the minimum value of the range, the desilvering effect can be improved. However, the solution is degraded and the cyan dye is converted into a leuco form. However, if the pH of the solution is higher than the maximum value of the range, desilvering is delayed and stain tends to occur. The pH range of the bleaching solution is 4 to 7, and preferably 4.5 to 6.5. If the pH is 4 or less, the cyan dye is converted into a leuco form. However, if the pH exceeds 7 or more, desilvering is delayed.

In order to adjust the pH of the solution, hydrochloric acid, sulfuric acid, nitric acid, acetic acid, bicarbonate, ammonia, patassium hydroxide, solium hydroxide, sodium carbonate, potassium carbonate, or the like can be added to the solution.

The bleach-fixing solution and the fixing solution contain a phosphorous acid ion releasing compound as a preservatives such as a sulfite (e.g., sodium sulfite, potassium sulfite, or ammonium sulfite), a bisulfite (e.g., ammonium bisulfite, sodium bisulfite, or potassium bisulfite), or a methabisulfite (e.g., potassium methabisulfite, sodium methabisulfite, or ammonium methabisulfite). The content of these compounds is about 0.02 to 0.50 mol/l, and more preferably 0.04 to 0.40 mol/l as an amount of sulfite ion.

A typical preservative is a sulfite. However, ascorbic acid, a carbonyl bisulfite, acid adduct, or a carbonyl compound may be used.

A desilvering temperature is preferably a high temperature unless transient softening of a gelatin film and degradation of the process solution occur. The desilvering temperature normally falls within the range of 30° to 50° C. Desilvering time varies according to a desilvering method but is normally 4 minutes or less, and preferably 30 seconds to 3 minutes.

3-5. Washing and Stabilizing

After desilvering such as fixing or bleach-fixing, the photographic light-sensitive material of the present invention is normally subjected to washing and/or stabilizing.

An amount of water used in the washing process can be arbitrarily determined over a broad range in accordance with the properties (e.g., a property determined by use of a coupler and the like) of the photographic light-sensitive material, the use of the material, the temperature of the water, the number of water tanks (the number of stages), the replenishing scheme representing a counter or forward current, and other conditions. The relationship between the amount of water and the number of water tanks in a multi-stage counter-current scheme can be obtained by a method described in "Journal of the Society of Motion Picture and Television Engineers", No. 64, PP. 248–253 (May, 1955). In general, the number of water tanks in the counter-current scheme is preferably 2 to 6, and more preferably 2 to 4.

According to the multi-stage counter-current scheme, the amount of water used for washing can be greatly decreased and can be 0.5 l to 1 l or less per square meters of photographic light-sensitive material. However, since washing water stays in the tanks for a long period of time, bacretia grow and floating products may be undesirably attached to the light-sensitive material. In order to solve the above problem in the process of the color photographic light-sensitive material of the present invention, a method for decreasing calcium and magnesium ions can be effectively utilized, as described in Japanese Patent Application No. 61-131,632. In addition, an isothiazolone compound and cyabendazole, as described in Japanese Patent Application (OPI) No. 57-8,542, a chlorine type germicide such as chlorinated sodium isocyanurate, described in Japanese Patent Application (OPI) No. 61-120,145, benzotriazole described in Japanese Patent Application No. 60-105,487, and germicides described in "Chemistry of Antibacterial and Antifungal Agents", Hiroshi Horiguchi, "Sterilization, Antibacterial, and Antifungal Techniques for Microorganisms" Eiseiqijutsu-Kai ed., and "Dictionary of Bacteriacidal and Antifungal Agents", Nippon Bokin Bokabi Gakkai ed.

A surfactant serving as a wetting agent and a chelating agent represented by EDTA serving as a water-softener can be used in washing water.

The pH of the water for washing the photographic light-sensitive material of the present invention is 4 to 9 and preferably 5 to 8. The water temperature and the washing time can vary according to the properties of the light-sensitive material and its application. Normally, the washing time falls within the range of 20 seconds to 10 minutes at a temperature of 15° to 45° C., and preferably 30 seconds to 5 minutes at a temperature of 25° to 40° C.

The photographic light-sensitive material can be treated with a stabilizing solution after it is washed with water or without being washed. The stabilizing solution contains a compound having an image stabilization function. Examples of such a compound are an aldehyde compound such as formaldehyde, a buffering agent for controlling the pH suitable for dye stabilization, and an ammonium compound. In addition, in order to prevent an increase in bacteria in the solution and provide an antifungal property to the photographic light-sensitive material, the above-mentioned various bacteriacides and antifungal agents are used.

Further, a surfactant, a fluorescent whitener, and a hardener can be used. If stabilization is performed without performing the wash process, all known methods such as those described in Japanese Patent Application (OPI) Nos. 57-8,543, 58-14,834, 59-184,343, 60-220,345, 60-238,832, 60-239,784, 60-239,749, 61-4,054, and 61-118,749 can be used.

Furthermore, a chelating agent such as 1-hydroxyethylidene-1,1-diphosphonic acid or ethylenediaminetetramethylenephosphonic acid, and a bismuth compound can be preferably used.

The solutions used in washing and/or stabilizing steps can be used again in the previous steps. An overflow portion of washing water obtained by reduced the amount of water according to the multi-stage counter current flow can be supplied to the preceding bleach-fixing bath. The bleach-fixing bath is replenished with a condensed solution to reduce the amount of effluent.

3-6. Developing Method

When a large amount of photographic light-sensitive material is processed by the developing method of the present invention, the continuous process is preferred. If the photographic light-sensitive material is a disk film, the exposed material is placed in predetermined baths, and color development, bleaching-fixing, and wash/stabilization can be sequentially performed. However, if the light-sensitive material is a roll-like film for photographing or color paper, the light-sensitive material is sequentially fed to the process baths. The feed method may be a guide film transport, a roller transport, or a guide-rack transport.

In order to continuously process a long light-sensitive material, the process baths are replenished with corresponding process solutions, thereby replenishing for compensating the consumed components and preventing trouble associated with storage of containing eluted components of the light-sensitive material in the effluent. It is also preferable to correct changes in composition caused by oxidation of the developing solution when it is brought into contact with air. Countermeasures are provided to reduce the amount of solution to be replenished therefor the amount of effluent. In particular, utilization of the overflow portion of the wash/-stabilization solution has been described above. In addition, an overflow portion of the developing solution can be used in the bleach-fixing bath.

The total developing time from the start of development to the end of drying can be about 1 to 5 minutes, preferably 1 to 3.5 minutes, and most preferably 120 seconds or less.

EXAMPLE 1

After two emulsions (G and H) containing silver chlorobromide grains according to the present invention six emulsions (A to F) for comparison were prepared in a method to be described later, an emulsion suspension of a magenta coupler (M-1) and a hardener (H-1) were added to all the silver halide emulsions. These mixtures were applied to undercoated cellulose tetraacetate transparent film supports to prepare eight color photographic light-sensitive materials (samples 101 to 108). Gelatin protective layers (coating amount: 2.4 g/m$^2$) were respectively formed on silver halide emulsion layers (coating amount: 1. 6 g/mp$^2$ of silver; 0.95 g/m$^2$ of magneta coupler (M-1); and 0.8 g/m$^2$ of tricredylphosphate as a coupler solvent) of these light-sensitive materials. Samples 101 to 108 were then subjected to sensitometric exposure and then development to be described. The measured values of sensitivity and fogging are summarized in Table 2.

A silver halide emulsion (i) was prepared as follows:

| | |
|---|---|
| Solution 1: | |
| Water | 800 ml |
| NaCl | 4.5 g |
| Gelatin | 25 g |
| Solution 2: | |
| Compound defined below (1% aqueous solution) | 3 ml |

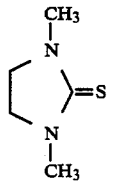

| | |
|---|---|
| Solution 3: | |
| KBr | 0.34 g |
| NaCl | 1.53 g |
| Water to make | 140 ml |

-continued

| | |
|---|---|
| Solution 4: | |
| $AgNO_3$ | 5.0 g |
| Water to make | 140 ml |
| Solution 5: | |
| KBr | 8.3 g |
| NaCl | 37.2 g |
| Water to make | 320 ml |
| Solution 6: | |
| $AgNO_3$ | 120 g |
| Water to make | 320 ml |

Solution 1 was heated to 55° C. and was added to Solution 2. Solutions 3 and 4 were simultaneously added to the resultant mixture for 10 minutes. Solutions 5 and 6 were simultaneously added to the resultant mixture for 35 minutes. Five minutes after the addition, the temperature of the solution was decreased, and the solution was desalted.

An aqueous solution of gelatin for dispersion was added to the desalted solution and the pH of the solution were adjusted to 6.2, thereby preparing a monodispersion cubic silver chlorobromide emulsion (i) having an average grain size of 0.72 μm and a variation coefficient of 0.13 (a value obtained by dividing the standard deviation by the average grain size). Sodium thiosulfate, chloroauric acid, and rhodan ammonium were added to the emulsion (i) at 58° C., thereby performing optimal chemical sensitization. $1.2\times10^{-4}$ mol of CR-7 and the same amount of CR-10 each per mol of the silver halide were added to the chemically sensitized emulsion thereby performing spectral sensitization. 4-hydroxy-6-methyl-1,3,3a,7-tetrazaindene was added as a stabilizer to prepare the emulsion (A).

$1.2\times10^{-4}$ mol of CR-7 and the same amount of CR-10 each per mol of the silver halide were added to the emulsion (i) at 58° C. Sodium thiosulfate, chloroauric acid, and rhodan ammonium were added to the resultant mixture, thereby performing optimal chemical sensitization. 4-hydroxy-6-methyl-1,3,3a,7-tetrazaindene was added as a stabilizer thereby preparing the emulsion (B).

The emulsion (C) was prepared by the same procedures as in the emulsion (A), except that Solution 7 was added to the mixture 10 minutes after Solutions 5 and 6 were added, and 15 minutes later, the temperature of the resultant mixing solution was decreased.

| | |
|---|---|
| Solution 7: | |
| KBr | 1.82 g |
| Water to make | 50 ml |

Two mol % of a silver bromide emulsion (grain size: 0.05 μm) per mole of the emulsion (i) was added to the emulsion (i) at 58° C. After 10 minutes, sodium thiosulfate, chloroauric acid, and rhodan ammonium were added to the resultant mixture, thereby performing optimal chemical sensitization. $1.2\times10^{-4}$ mol of CR-7 and the same amount of CR-10 each per mol of the silver halide were added to the chemically sensitized emulsion to perform spectral sensitization. 4-hydroxy-6-methyl-1,3,3a,7-tetrazaindene was added as a stabilizer thereby preparing the emulsion (D).

The emulsion (E) was prepared following the same procedures as in the emulsion (C) except that CR compounds CR-7 and CR-10 were added to the silver halide emulsion before chemical sensitization was performed.

The emulsion (F) was prepared by the same procedures as in the emulsion (D) except that CR compounds CR-7 and CR-10 were added to the silver halide emulsion before chemical sensitization was performed.

After $1.2\times10^{-4}$ mol of CR-7 and the same amount of CR-10 each per mol of the silver halide were added to the emulsion (i) at 58° C., Solution 7 was added to the solution for 10 minutes. Sodium thiosulfate, chloroauric acid, and rhodan ammonium were added to the resultant mixture, thereby performing optimal chemical sensitization. 4-hydroxy-6-methyl-1,3,3a,7-tetrazaindene was added as a stabilizer to prepare the emulsion (G).

The emulsion (H) was prepared following the same procedures as in the emulsion (D) except that CR compounds CR-7 and CR-10 were added to the silver halide emulsion before the silver bromide emulsion was added.

Eighty grams of the magenta coupler (M-1) were dissolved in a mixture solution of 70 ml of tricresylphosphate and 250 ml of ethyl acetate, and the resultant solution was emulsified and dispersed in 1,000 g of a 10% gelatin aqueous solution containing 6.0 g of sodium dodecylbenzenesulfonate acid to prepare an emulsified dispersion. A compound used in this dispersion has the following formula.

-continued

| | |
|---|---|
| Potassium Carbonate | 30.0 g |
| Potassium Bromide | 1.4 g |
| Potassium Iodide | 1.3 mg |
| Hydroxyamine | 2.4 g |
| 4-(N—ethyl-N—β-hydroxyethylamino)-2-methylaniline sulfate | 4.5 g |
| Water to make | 1 liter |
| | pH 10.0 |
| Bleaching Solution | |
| Ethylenediaminetetraacetic Acid Ferric Ammonium Salt | 100 g |
| Ethylenediaminetetraacetic Acid Di-sodium Salt | 10.0 g |
| Ammonium Aqueous Solution | 7 ml |
| Ammonium Nitrate | 10.0 g |
| Ammonium Bromide | 150 g |
| Water to make | 1 liter |
| | pH 6.0 |
| Fixing Solution | |
| Ethylenediaminetetraacetic Acid Di-sodium Salt | 1.0 g |
| Sodium Sulfite | 4.0 g |
| Sodium Bisulfite | 4.6 g |
| Ammonium Thiosulfate Aqueous Solution (70%) | 175 ml |
| Water to make | 1 liter |
| | pH 6.6 |

Magenta Coupler (M-1)

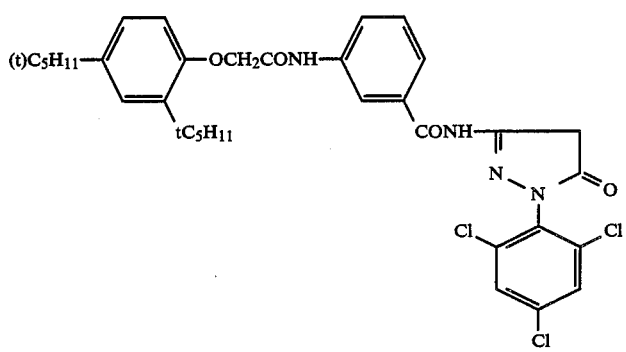

The eight samples 101 to 108 listed in Table 2 were formed on the transparent supports of cellulose triacetate. The hardener was H-2 below:

Hardening Agent (H-1)

$(CH_2{=}CHSO_2CH_2CONHCH_2)_2$

Sensimetric gradation exposure was performed for the coated samples by using a sensitometer (FWH type available from Fuji Photo Film Co., Ltd. (color temperature of light source: 4,800° K.). In this case, an exposure time was 1/100 second, and an amount of exposure was set to 10 CMS. Thereafter, the color development process to be described below was performed.

| Process | Time | Temperature | Tank Volume |
|---|---|---|---|
| Color Development | 1 min. 5 sec. | 38° C. | 18 l |
| Bleaching | 6 min. 30 sec. | 38° C. | 36 l |
| Fixing | 3 min. 15 sec. | 38° C. | 18 l |
| Washing 1 | 1 min. 30 sec. | 38° C. | 9 l |
| Washing 2 | 1 min. 30 sec. | 38° C. | 9 l |
| Stabilization | 40 sec. | 38° C. | 9 l |

| | |
|---|---|
| Color Developer | |
| Diethylenetriaminepentaacetic Acid | 1.0 g |
| 1-hydroxyethylidene-1,1-diphosphonic acid | 2.0 g |
| Sodium Sulfite | 4.0 g |
| Washing Water | |
| Tap Water (containing 27 mg/l of calcium and 10 mg/l of magnesium) | |
| Stabilizing Solution | |
| Formalin (37% W/V) | 2 ml |
| Polyoxyethylene-p-monononylphenylether (average polymerization degree: 10) | 0.3 g |
| Water to make | 1 liter |

Color densities of the samples after the process were measured to evaluate the sensitivity and the fogging density. The sensitivity was defined as an inverse number of the exposure amount for giving a color density higher by 0.2 than the fogging density, and the sensitivity values of the samples were defined when the sensitivity of the sample 101 was given as 100.

Results are summarized in Table 2.

As is apparent from Table 2, the photographic light-sensitive materials made from the emulsions of the presence invention has higher sensitivity than the materials prepared from other emulsions.

TABLE 2

| Sample No. | Emulsion | Sensitivity | Fogging | Remarks |
|---|---|---|---|---|
| 101 | Emulsion A | 100 | 0.20 | Comparison |
| 102 | Emulsion B | 120 | 0.19 | Comparison |
| 103 | Emulsion C | 123 | 0.22 | Comparison |
| 104 | Emulsion D | 135 | 0.21 | Comparison |

TABLE 2-continued

| Sample No. | Emulsion | Sensitivity | Fogging | Remarks |
|---|---|---|---|---|
| 105 | Emulsion E | 144 | 0.20 | Comparison |
| 106 | Emulsion F | 151 | 0.17 | Comparison |
| 107 | Emulsion G | 269 | 0.22 | Present Invention |
| 108 | Emulsion H | 282 | 0.23 | Present Invention |

EXAMPLE 2

A silver halide emulsion (ii) was prepared as follows:

| | |
|---|---|
| Solution 1: | |
| Water | 800 ml |
| NaCl | 4.5 g |
| Gelatin | 25 g |
| Solution 2: | |
| Compound defined below (1% aqueous solution) | 3 ml |

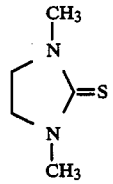

| | |
|---|---|
| Solution 3: | |
| NaCl | 1.7 g |
| Water to make | 140 ml |
| Solution 4: | |
| $AgNO_3$ | 5.0 g |
| Water to make | 140 ml |
| Solution 5: | |
| NaCl | 41.3 g |
| Water to make | 320 ml |
| Solution 6: | |
| $AgNO_3$ | 120 g |
| Water to make | 320 ml |

Solution 1 was heated to 55° C. and Solution 2 was added to the Solution 1. Solutions 3 and 4 were simultaneously added to the resultant mixture over 10 minutes. Solutions 5 and 6 were simultaneously added to the resultant mixture over 35 minutes. Five minutes after the addition, the temperature of the solution was decreased, and the solution was desalted.

A water and gelatin for dispersion were added to the desalted solution, and the pH of the solution was adjusted to 6.2, thereby preparing a mono-dispersion cubic silver chlorobromide emulsion (ii) having an average gain size of 0.70 μm and a variation coefficient of 0.13 (a value obtained by dividing the standard deviation by the average gain size). Sodium thiosulfate, chloroauric acid, and rhodan ammonium were added to the emulsion (ii) at 58° C., thereby performing optimal chemical sensitization. $1.2\times10^{-4}$ mol of CR-7 and the same amount of CR-10 each per mol of the silver halide were added to the chemically sensitized emulsion thereby performing spectral sensitization. 4-hydroxy-6-methyl-1,3,3a,7-tetrazaindene was added as a stabilizer to prepare an emulsion (a).

$1.2\times10^{-4}$ mol of CR-7 and the same amount of CR-10 each per mol of the silver halide were added to the emulsion (ii) at 58° C. Sodium thiosulfate, chloroauric acid, and rhodan ammonium were added to the resultant mixer, thereby performing optimal chemical sensitization. 4-hydroxy-6-methyl-1,3,3a,7-tetrazaindene was added as a stabilizer thereby preparing an emulsion (b).

An emulsion (c) was prepared by following the same procedures as in the emulsion (a) except that Solution 7 was added to the mixture for 10 minutes after Solutions 5 and 6 were added, and the temperature of the resultant solution was decreased after 5 minutes.

| Solution 7: | |
|---|---|
| KBr | 1.82 g |
| Water to make | 50 ml |

Two mol % of a silver bromide emulsion (grain size: 0.05 μm) per mol of the emulsion (ii) was added to the emulsion (ii) at 58° C. Ten minutes later, sodium thiosulfate, chloroauric acid, and rhodan ammonium were added to the resultant mixture to perform optimal chemical sensitization. $1.2\times10^{-4}$ mol of CR-7 and the same amount of CR-10 each per mol of the silver halide were added to the chemically sensitized emulsion to perform spectral sensitization. 4-hydroxy-6-methyl-1,3,3a,7-tetrazaindene was added as a stabilizer thereby preparing an emulsion (d).

An emulsion (e) was prepared by the same procedures as in the emulsion (c) except that CR compounds CR-7 and CR-10 were added to the silver halide emulsion before chemical sensitization was performed.

An emulsion (f) was prepared by the same procedures as in the emulsion (d) except that CR compounds CR-7 and CR-10 were added to the silver halide emulsion before chemical sensitization was performed.

After $1.2\times10^{-4}$ mol of CR-7 and the same amount of CR-10 each per mol of the silver halide were added to the emulsion (ii) at 58° C., and Solution 7 was added to the mixing solution for 10 minutes. Sodium thiosulfate, chloroauric acid, and rhodan ammonium were added to the resultant mixture, thereby performing optimal chemical sensitization. 4-hydroxy-6-methyl-1,3,3a,7-tetrazaindene was added as a stabilizer to prepare an emulsion (g).

An emulsion (h) was prepared by the same procedures as in the emulsion (d) except that CR compounds CR-7 and CR-10 were added to the silver halide emulsion before the silver bromide emulsion was added.

Samples 201 to 208 listed in Table 3 were prepared by following the same procedures as in Example 1, and exposure, development, and density measurement were performed to evaluate the sensitivity and the fogging density. In this case, the sensitivity values of the samples were defined when the sensitivity of the sample 201 was given as 100. Results are summarized in Table 3. The same effect as in Example 1 is obtained in Example 2.

As is evident from Table 3, Samples 207 and 208 achieved the advantage of the present invention, like Example 1.

TABLE 3

| Sample No. | Emulsion | Sensitivity | Fog | Remarks |
|---|---|---|---|---|
| 201 | Emulsion a | 100 | 0.20 | Comparison |
| 202 | Emulsion b | 126 | 0.22 | Comparison |
| 203 | Emulsion c | 141 | 0.21 | Comparison |
| 204 | Emulsion d | 138 | 0.20 | Comparison |
| 205 | Emulsion e | 251 | 0.23 | Comparison |
| 206 | Emulsion f | 240 | 0.21 | Comparison |
| 207 | Emulsion g | 1122 | 0.20 | Present |

TABLE 3-continued

| Sample No. | Emulsion | Sensitivity | Fog | Remarks |
|---|---|---|---|---|
| 208 | Emulsion h | 955 | 0.19 | Invention Present Invention |

Emulsions were prepared by the same procedures as in preparing Samples 207 and 208, except that the addition time of the CR compounds CR-7 and CR-10 were added (two minutes before the addition of Solutions 5 and 6 was completed during the preparation of emulsion (ii)). The resultant emulsions had the same photographic properties as those of Samples 207 and 208.

EXAMPLE 3

Sample 301 as a multilayered light-sensitive material having the following layers was formed on an undercoated cellulose triacetate film support.

Composition of Light-Sensitive Layers

An amount of material was measured in g/m$^2$ of silver for the silver halide and colloidal silver. amounts of a coupler, additive, and gelatine were measured in g/m$^2$, and an amount of a sensitizing dye was measured in mole per mol of the silver halide in the corresponding layer. The chemical formulas or names of the compounds used in the present Example were summarized in Table 9.

| | |
|---|---|
| Layer 1: Antihalation layer | |
| Black Colloidal Silver | 0.2 |
| Gelatin | 1.3 |
| Colored Coupler C-1 | 0.06 |
| Ultraviolet Absorbent UV-1 | 0.1 |
| Ultraviolet Absorbent UV-2 | 0.2 |
| Dispersion Oil Oil-1 | 0.01 |
| Dispersion Oil Oil-2 | 0.01 |
| Layer 2: Interlayer: | |
| Silver Chloride Particles (average grain size: 0.07 μm) | 0.15 |
| Gelatin | 1.0 |
| Colored Coupler C-2 | 0.02 |
| Dispersion Oil Oil-2 | 0.1 |
| Layer 3: 1st Red-Sensitive Emulsion Layer: | |
| Emulsion (1) listed in Table 4 (average grain size: 0.4 μm; and variation coefficient: 0.12) | |
| silver | 1.0 |
| Sensitizing Dye I | $1.5 \times 10^{-4}$ |
| Sensitizing Dye II | $3.5 \times 10^{-4}$ |
| Sensitizing Dye III | $1.5 \times 10^{-5}$ |
| Coupler C-3 | 0.48 |
| Coupler C-4 | 0.48 |
| Coupler C-8 | 0.08 |
| Coupler C-2 | 0.08 |
| Dispersion Oil Oil-1 | 0.30 |
| Dispersion Oil Oil-3 | 0.04 |
| Layer 4: 2nd Red-Sensitive Emulsion Layer: | |
| Emulsion (2) listed in Table 4 (average grain size: 0.7 μm; and variation coefficient: 0.10) | |
| silver | 1.0 |
| Gelatin | 1.0 |
| Sensitizing Dye I | $1 \times 10^{-4}$ |
| Sensitizing Dye II | $3 \times 10^{-4}$ |
| Sensitizing Dye III | $1 \times 10^{-5}$ |
| Coupler C-6 | 0.05 |
| Coupler C-7 | 0.1 |
| Dispersion Oil Oil-1 | 0.01 |
| Dispersion Oil Oil-2 | 0.05 |
| Layer 5: Interlayer: | |
| Gelatin | 1.0 |
| Compound Cpd-A | 0.03 |

-continued

| | |
|---|---|
| Dispersion Oil Oil-1 | 0.05 |
| Layer 6: 1st Green-Sensitive Emulsion Layer: | |
| Emulsion (3) listed in Table 4 (average grain size: 0.4 μm; and variation coefficient: 0.12) | |
| silver | 0.8 |
| Sensitizing Dye IV | $5 \times 10^{-4}$ |
| Sensitizing Dye V | $2 \times 10^{-4}$ |
| Coupler C-9 | 0.50 |
| Coupler C-1 | 0.06 |
| Coupler C-10 | 0.03 |
| Coupler C-5 | 0.02 |
| Dispersion Oil Oil-1 | 0.4 |
| Layer 7: 2st Green-Sensitive Emulsion Layer: | |
| Emulsion (4) listed in Table 4 (average grain size | 0.7 μm; and |
| variation coefficient: 0.10) | |
| silver | 0.85 |
| Gelatin | 1.0 |
| Sensitizing Dye IV | $3.5 \times 10^{-4}$ |
| Sensitizing Dye V | $1.4 \times 10^{-4}$ |
| Coupler C-11 | 0.01 |
| Coupler C-12 | 0.03 |
| Coupler C-13 | 0.20 |
| Coupler C-1 | 0.02 |
| Coupler C-15 | 0.02 |
| Dispersion Oil Oil-1 | 0.20 |
| Dispersion Oil Oil-2 | 0.05 |
| Layer 8: Yellow Filter Layer | |
| Gelatin | 1.2 |
| Yellow Collidal Silver | 0.08 |
| Compound Cpd-B | 0.1 |
| Dispersion Oil Oil-1 | 0.3 |
| Layer 9: 1st Blue-Sensitive Emulsion Layer: | |
| Emulsion (5) listed in Table 4 (average grain size: 0.4 μm; and variation coefficient: 0.12) | |
| silver | 0.4 |
| Gelatin | 1.0 |
| Sensitizing Dye IV | $2 \times 10^{-4}$ |
| Coupler C-14 | 0.9 |
| Coupler C-5 | 0.07 |
| Dispersion Oil Oil-1 | 0.2 |
| Layer 10: 2nd Blue-Sensitive Emulsion Layer | |
| Emulsion (6) listed in Table 4 (average grain size: 0.7 μm; and variation coefficient: 0.10) | |
| silver | 0.5 |
| Gelatin | 0.6 |
| Sensitizing Dye IV | $1 \times 10^{-4}$ |
| Coupler C-14 | 0.25 |
| Dispersion Oil Oil-1 | 0.07 |
| Layer 11: 1st Protective Layer: | |
| Gelatin | 0.8 |
| Ultraviolet Absorbent UV-1 | 0.1 |
| Ultraviolet Absorbent UV-2 | 0.2 |
| Dispersion Oil Oil-1 | 0.01 |
| Dispersion Oil Oil-2 | 0.01 |
| Layer 12: 2nd Protective Layer: | |
| Silver Chloride Particles (average grain size: 0.07 μm) | 0.5 |
| Gelatin | 0.45 |
| Polymethyl Methacrylate Particles (grain size: 1.5 μm) | 0.2 |
| Hardener H-1 | 0.4 |
| Formaldehyde Scavenger S-1 | 0.5 |
| Formaldehyde Scavenger S-2 | 0.5 |

A surfactant was added as a coating additive to each of above-mentioned layers in addition to the components described above. The resultant sample was used as Sample 301.

TABLE 4

| | Sample 301 (Comparison) | Sample 302 (Comparison) | Sample 303 (Comparison) | Sample 304 (Present Invention) |
|---|---|---|---|---|
| Layer 3 | Emulsion | Emulsion | Emulsion | Emulsion |

TABLE 4-continued

| | Sample 301 (Comparison) | Sample 302 (Comparison) | Sample 303 (Comparison) | Sample 304 (Present Invention) |
|---|---|---|---|---|
| Layer 4 | (1) Emulsion | (7) Emulsion | (13) Emulsion | (19) Emulsion |
| Layer 6 | (2) Emulsion | (8) Emulsion | (14) Emulsion | (20) Emulsion |
| Layer 7 | (3) Emulsion | (9) Emulsion | (15) Emulsion | (21) Emulsion |
| Layer 9 | (4) Emulsion | (10) Emulsion | (16) Emulsion | (22) Emulsion |
| Layer 10 | (5) Emulsion | (11) Emulsion | (17) Emulsion | (23) Emulsion |
| | (6) | (12) | (18) | (24) |

The emulsion (1) for the third layer, the emulsion (2) for the fourth layer, the emulsion (3) for the sixth layer, the emulsion (4) for the seventh layer, the emulsion (5) for the ninth layer, and the emulsion (6) for the 10th layer were modified as shown in Table 4, to prepare samples 302 to 304. The properties of the resultant emulsions are summarized in Table 5.

A sensitizing dye as the CR compound was used in Samples 303 and 304. The emulsions used in Samples 301 to 304 were prepared as described below.

Preparation of Emulsions (1)-(6)

The emulsions (1) to (6) were prepared by the same procedures as in the emulsion a in Example 2, such that the grain formation temperature was changed to change the grain sizes, and sodium thiosulfate was used to perform optimal chemical sensitization.

Preparation of Emulsions (7)-(12)

The emulsions (7) to (12) were prepared by the same grain formation procedures as in the emulsions (1) to (6) and by adding sodium thiosulfate, chloroauric acid, and rhodan ammonium in chemical sensitization.

Preparation of Emulsions (13)-(18)

The emulsions (13) to (18) were prepared in the following manner. The same grain formation procedures as in preparing the emulsions (1) to (6) was performed. The CR compound was added in the same way as in Example 2. Then, 2 mol % of AgBr (0.05 μm) per mol of the silver halide was added to perform halogen conversion at 58° C. for 10 minutes. Finally, sodium thiosulfate was added to perform optimal chemical sensitization.

Preparation of Emulsions (19)-(24)

The emulsions (19) to (24) were prepared by adding sodium thiosulfate, chloroauric acid, and rhodan ammonium to the emulsions (13) to (18) to perform chemical sensitization.

TABLE 5

| Emulsion | Silver Bromide *1 (mol %) | Average Grain Size *2 (μm) | Grain Shape | Used CR Compound | Chemical Sensitization by Chloroauric Acid |
|---|---|---|---|---|---|
| (1) | 0 | 0.4 | Cubic | — | No |
| (2) | " | 0.7 | " | — | " |
| (3) | " | 0.4 | " | — | " |
| (4) | " | 0.7 | " | — | " |
| (5) | " | 0.4 | " | — | " |
| (6) | " | 0.7 | " | — | " |
| (7) | " | 0.4 | " | — | Yes |
| (8) | " | 0.7 | " | — | " |
| (9) | " | 0.4 | " | — | " |
| (10) | " | 0.7 | " | — | " |
| (11) | " | 0.4 | " | — | " |
| (12) | " | 0.7 | " | — | " |
| (13) | 2.0 | 0.4 | " | Sensitizing Dyes I, II, III | No |
| (14) | " | 0.7 | " | " | " |
| (15) | " | 0.4 | " | Sensitizing Dyes IV, V | " |
| (16) | " | 0.7 | " | " | " |
| (17) | " | 0.4 | " | Sensitizing Dye VI | " |
| (18) | " | 0.7 | " | " | " |
| (19) | 2.0 | 0.4 | Cubic | Sensitizing Dyes I, II, III | Yes |
| (20) | " | 0.7 | " | " | " |
| (21) | " | 0.4 | " | Sensitizing Dyes IV, V | " |
| (22) | " | 0.7 | " | " | " |
| (23) | " | 0.4 | " | Sensitizing Dyes VI | " |
| (24) | " | 0.7 | " | — | " |

Note:
*1: Silver bromide was contained by halogen conversion with fine grains AgBr (0.05 μm) presence of the CR compound by following the same procedures as in Example 1.
*2: The grain size was controlled by changing the grain formation temperature.

25 CMS 1/100 sec. exposure was performed for these photographic elements using a tungsten light source and a filter at a color temperature of 4,800° K. The elements were developed at 38° C. as follows:

| | |
|---|---|
| Color Development | 2 min. 15 sec. |
| Bleach | 6 min. 30 sec. |
| Wash | 2 min. 10 sec. |
| Fix | 4 min. 20 sec. |
| Wash | 3 min. 15 sec. |
| Stabilization | 1 min. 05 sec. |

The compositions of the process solutions are represented as follows:

| | |
|---|---|
| Color Developer | |
| Diethylenetriaminepentaacetic Acid | 1.0 g |
| 1-hydroxyethylidene-1,1-diphosphonic acid | 2.0 g |
| Sodium Sulfite | 4.0 g |
| Potassium Carbonate | 30.0 g |
| Potassium Bromide | 1.4 g |
| Hydroxyamine Sulfate | 2.4 g |
| 4-(N—ethyl-N—β-hydroxyethylamino)-2-methylanilinesulfate | 4.5 g |
| Water to make | 1 liter |
| | pH 10.0 |
| Bleaching Solution | |
| Ethylenediaminetetraacetic Acid Ferric Ammonium Salt | 100 g |
| Ethylenediaminetetraacetic Acid Di-sodium Salt | 10.0 g |
| Ammonium Bromide | 150 g |
| Ammonium Nitrate | 10.0 g |
| Water to make | 1 liter |
| | pH 6.0 |
| Fixing Solution | |
| Ethylenediaminetetraacetic Acid | |

-continued

| | |
|---|---|
| Di-sodium Salt | 1.0 g |
| Sodium Sulfite | 4.0 g |
| Ammonium Thiosulfate Aqueous Solution (70%) | 175 ml |
| Sodium Bisulfite | 4.6 g |
| Water to make | 1 liter |
| | pH 6.6 |
| Stabilizing Solution | |
| Formalin (40%) | 2.0 ml |
| Polyoxyethylene-p-monononyl-phenylether (average polymerization degree: 10) | 0.3 g |
| Water to make | 1 liter |

The optical densities of Samples 301 to 304 processed as described above were measured with red, green, and blue light. Results are summarized in Table 6. "Relative sensitivity" in Table 6 is defined as the reciprocal the exposure amount of giving a coloring density corresponding to (minimum density+0.2).

TABLE 6

| Sample No. | Relative Sensitivity Red-Sensitive Layer | Green-Sensitive Layer | Blue-Sensitive Layer | Remarks |
|---|---|---|---|---|
| 301 | 100 (Reference) | 100 (Reference) | 100 (Reference) | Comparison |
| 302 | 158 | 170 | 166 | Comparison |
| 303 | 400 | 417 | 389 | Comparison |
| 304 | 1584 | 1778 | 1514 | Present Invention |

Sample 304 chemically sensitized by chloroauric acid has higher sensitivity than the comparative examples, as shown in Table 6, and therefore the effect of the present invention can thus be proved.

EXAMPLE 4

Sample 304 was processed, as shown in Table 7, on the basis of ISO speed calculation of color negative film for still photographing of the JIS standards (JIS K7614-1986) to measure the ISO sensitivity. Sample 304 had an ISO sensitivity of 64 and was thus confirmed that the Sample 304 had sufficiently high sensitivity for light-sensitive material for photographing.

TABLE 7

| Process | Time | Temperature | Replenishing Amount | Tank Volume |
|---|---|---|---|---|
| Color Development | 1 min. 05 sec. | 38° C. | 10 ml | 4 l |
| Bleach-Fixing | 1 min. 30 sec. | 38° C. | 20 ml | 4 l |
| Wash (1) | 20 sec. | 35° C. | Counter flow piping from (2) to (1) | 2 l |
| Wash (2) | 20 sec. | 35° C. | 10 ml | 2 l |
| Dry | 50 sec. | 65° C. | | |

The compositions of the process solutions are represented as follows:

| Color Developing Solution | Mother Solution | Replenishment Solution |
|---|---|---|
| Water | 900 ml | 900 ml |
| Potassium Chloride | 1.0 g | 1.0 g |
| Potassium Carbonate | 34.6 g | 38.0 g |
| Sodium Bicarbonate | 1.8 g | 2.0 g |
| Ethylenediamine-N—N,N,N—tetramethylenephosphonatic acid | 1.0 g | 1.2 g |
| Triethylenediamine-(1,4-diazabicylo[2,2,2]-octane | 5.3 g | 6.0 g |
| Diethylhydroxylamine | 4.2 g | 5.5 g |
| 3-methyl-4-amino-N—ethyl-N—β-hydroxyethylaniline sulfate | 4.6 g | 7.5 g |
| Potassium hydroxide to make | pH 10.05 | pH 10.15 |
| Water to make | 1.0 l | 1.0 l |
| Bleach-Fixing Solution (g): | | |
| Mother and replenishment Solutions are common. | | |
| Ethylenediaminetetraacetic Acid Ferric Ammonium Dihydrate Salt | | 90.0 g |
| Ethylenediaminetetraacetic Acid Di-Sodium Salt | | 10.0 g |
| Sodium Sulfite | | 12.0 g |
| Ammonium Thiosulfate Aqueous Solution (70%) | | 260.0 ml |
| Acetic Acid (98%) | | 5.0 ml |
| Accelerator for Bleaching | | 0.01 mol |

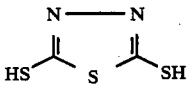

| | |
|---|---|
| Water to make | 1.0 liter |
| | pH 6.0 |
| Wash Solution: Mother and replenishment Solutions are common. | |

Tap water is supplied to a mixed-bed column filled with an H type strong acidic cation exchange resin (Ambelite IR-120B available from Rohm & Haas Co.) and an OH type anion exchange resin (Umberite IR-400) to set the concentrations of calcium and magenesium ions to be 3 mg/l or less. Subsequently, 20 mg/l of sodium bichlorinated isocyanurate and 0.15 g/l of sodium sulfate were added. The pH of the resultant solution fell within the range of 6.5 to 7.5.

By using the emulsions of the present invention, the sensitivities of intrinsic spectral region and spectrally sensitized regions have increased, and their stability has also been improved.

Fogging has been minimized even if high-temperature, rapid process was performed, thus improving stability. In addition, the hard emulsion has been obtained, and desensitizing by pressure has been lowered. Therefore, fogging of the nonexposed portion, due to a pressure, has been minimized.

EXAMPLE 5

Multilayered color print paper having the following layers was prepared on a paper support on two surfaces of which a polyethylene film was laminated.

A coating solution was prepared by mixing and dissolving emulsions, various chemicals, and emulsified dispersion of couplers. Methods of preparing the coating solution will be described below.

Preparation of Coupler Emulsion 19.1 g of an yellow coupler (Ex Y) and 4.4 g of a color image stabilizer (Cpd-1) were added to and dissolved in 27.2 cc of ethyl acetate and 7.7 cc of a solvent (Solv-1). The resultant solution was emulsified and dispersed in 185 $cm^3$ of a 10% gelatin aqueous solution containing 8 $cm^3$ of 10% sodium dodecylbenzenesulfonate.

Emulsions for magneta, cyan, and interlayer were prepared following the same procedures as described above.

Compounds used in respective emulsions are summarized in Table 13 presented later.

$2.5\times10^{-4}$ mol of a stabilizer ([XXI]-(7)) per unit mol of the silver halide were added to a blue-sensitive emulsion layer.

A gelatin hardner for each layer was 1-oxy-3,5-dichloro-s-triadine sodium salt.

In order to prevent irradiation, dyes Ex-3a and Ex-3b listed in Table 13 presented later were added to the emulsion layers.

$2.6\times10^{-3}$ mol of compound Ex-3c listed in Table 13 presented below per unit mol of the silver halide were added to a red-sensitive emulsion layer.

A method of preparing an emulsion, employed in this example will be described.

Optimal chemical sensitization was performed on the emulsions 301 to 306 listed in Table 10, which were used instead of emulsion b used in Example 2.

TABLE 10

| Emulsion | Grain Forming Temperature | Silver*1 Bromide (mol %) | Used CR Compound | Grain Size (μ) | Variation Coefficient (%) |
|---|---|---|---|---|---|
| (301) | 55° C. | 0 | Ex Dye B $2.3\times10^{-4}$ mol/mol Ag | 0.7 | 13 |
| (302) | 55° C. | 1 | " | 0.7 | 13 |
| (303) | 42° C. | 0 | Ex Dye G $4\times10^{-4}$ mol/mol Ag | 0.4 | 12 |
| (304) | 42° C. | 2 | " | 0.4 | 12 |
| (305) | 42° C. | 0 | Ex Dye R $1.5\times10^{-4}$ mol/mol Ag | 0.4 | 12 |
| (306) | 42° C. | 2 | " | 0.4 | 12 |

*1 A bromide was contained following the same procedures as emulsion h in Example 1.

$10^{-4}$ mol/mol Ag of compound Ex-3d listed in Table 13 were added as a stabilizer to each of these emulsions.

These emulsions were combined as shown in Table 11 and coated to prepare samples 501 to 509.

All couplers were substituted by equimolar conversion.

TABLE 11

| Sample | Layer 1 Emulsion | Layer 1 Coupler | Layer 2 Emulsion | Layer 2 Coupler | Layer 3 Emulsion | Layer 3 Coupler | Remarks |
|---|---|---|---|---|---|---|---|
| 501 | (301) | Ex Y | (303) | Ex M1 | (305) | Mixture of Ex C1 and C2 at Weight Ratio of 1:1 | Comparative Example |
| 502 | (302) | Ex Y | (304) | Ex M1 | (306) | Ex C2 | Present Invention |
| | | | | | | Ex C2 | " |
| 503 | (302) | Ex Y | (304) | Ex M1 | (306) | Ex C2 | " |
| 504 | (302) | Ex Y | (304) | Ex M2 | (306) | Ex C4 | " |
| 505 | (302) | Ex Y | (304) | Ex M3 | (306) | Ex C4 | " |
| 506 | (302) | Ex Y | (304) | Ex M4 | (306) | Ex C4 | " |
| 507 | (302) | Ex Y | (304) | Ex M3 | (306) | Ex C3 | " |
| 508 | (302) | Ex Y | (304) | Ex M3 | (306) | Ex C5 | " |
| 509 | (302) | Ex Y | (304) | Ex M3 | (306) | Ex C1 | " |

(Layer Structure)

Compositions of layers in sample 501 will be described below. Numerals indicate coating amounts (g/m²). The silver halide emulsion is represented in a silver-converted coating amount.

| Support<br>Polyethylene Laminate Paper<br>[Polyethylene on first layer side containing white pigment ($TiO_2$) and bluish dye (navy blue)] | |
|---|---|
| Layer 1 (Blue-sensitive Layer): | |
| Silver Halide Emulsion | 0.30 |
| Gelatin | 1.86 |
| Yellow Coupler (Ex Y) | 0.82 |
| Color Image Stabilizer (Cpd-1) | 0.19 |
| Solvent (Solv-1) | 0.35 |
| Layer 2 (Color Mixing Preventive Layer): | |
| Gelatin | 0.99 |
| Color Mixing Preventive Agent (Cpd-2) | 0.08 |
| Layer 3 (Green-sensitive Layer): | |
| Silver Halide Emulsion | 0.36 |
| Gelatin | 1.24 |
| Magenta Coupler (Ex M1) | 0.31 |
| Color Image Stabilizer (Cpd-3) | 0.25 |
| Color Image Stabilizer (Cpd-4) | 0.12 |
| Solvent (Solv-2) | 0.42 |
| Layer 4 (Ultraviolet Absorption Layer): | |
| Gelatin | 1.58 |
| Ultraviolet Absorbent (UV-1) | 0.62 |
| Color Mixing Preventive Agent (Cpd-5) | 0.05 |
| Solvent (Solv-3) | 0.24 |
| Layer 5 (Red-sensitive Layer): | |
| Silver Halide Emulsion | 0.23 |
| Gelatin | 1.34 |
| Cyan Coupler (1:1 mixture of Ex Cl & Ex C2) | 1.34 |
| Color Image Stabilizer (Cpd-6) | 0.17 |
| Polymer (Cpd-7) | 0.40 |
| Solvent (Solv-4) | 0.23 |
| Layer 6 (Ultraviolet Absorption Layer): | |
| Gelatin | 0.53 |
| Ultraviolet Absorbent (UV-1) | 0.21 |
| Solvent (Solv-3) | 0.08 |
| Layer 7 (Protective Layer) | |
| Gelatin | 1.33 |
| Acrylic Denaturated Copolymer of Polyvinyl Alcohol (Degree of denaturation: 17%) | 0.17 |
| Liquid Paraffin | 0.03 |

The following experiment was conducted to examine photographic properties of these coated samples.

Sensitometric gradation exposure was performed for the coated samples through a green filter using an sensitometer FWH (available from Fuji Photo Film Co., Ltd.; color temperature of light source: 300° K.). In this case, exposure was performed for an exposure time of 1/10 sec to obtain an amount of exposure of 250 CMS.

Thereafter, the following color developing process was performed.

| (Process) | (Temperature) | (Time) |
|---|---|---|
| Color Development | 35° C. | 45 sec |

-continued

| | | |
|---|---|---|
| Bleach/Fix | 35° C. | 45 sec |
| Wash | 28–35° C. | 90 sec |
| Color Developing Solution | | |
| Triethanolamine | | 8.12 g |
| N,N—diethylhydroxylamine | | 4.93 g |
| Phosphor Bleach Solution (UVITEXCK, available from Ciba-Geigy Corp.) | | 2.80 g |
| 4-amino-3-methyl-N—ethyl-N—[β-(methanesulfoneamido)ethyl]-p-phenylenediamine sulfate | | 4.96 g |
| Sodium sulfite | | 0.13 g |
| Potassium carbonate | | 18.40 g |
| Potassium hydrogencarbonate | | 4.85 g |
| EDTA.2Na.2$H_2O$ | | 2.20 g |
| Sodium chloride | | 1.36 g |
| Water to make | | 1000 ml |
| | | pH 10.05 |
| Bleach/Fixing Solution | | |
| Ammonium thiosulfate (54 wt %) | | 103.0 ml |

Densities of processed samples 501 to 509 were measured using red, green, and blue rays to make comparison of sensitivities and fogging of blue-, green-, and red-sensitive layers. The results are summarized in Table 12.

Note that a relative sensitivity of sample 502 was set to be 100.

As can be seen from the results shown in Table 12, combinations of the present invention could have higher sensitivity than comparative examples.

In Table 12, the relative sensitivity is the reciprocal of the exposure amount of giving a coloring density necessary for providing a density of 1.0.

TABLE 12

| Sample No. | Sensitivity B | Sensitivity G | Sensitivity R | Fogging B | Fogging G | Fogging R | Remarks |
|---|---|---|---|---|---|---|---|
| 501 | 20 | 20 | 20 | 0.24 | 0.28 | 0.26 | Comparative Example |
| 502 | 100 | 100 | 100 | 0.16 | 0.13 | 0.14 | Present Invention |
| 503 | 103 | 100 | 100 | 0.16 | 0.13 | 0.14 | " |
| 504 | 100 | 103 | 110 | 0.15 | 0.12 | 0.14 | " |
| 505 | 100 | 104 | 110 | 0.15 | 0.13 | 0.14 | " |
| 506 | 101 | 104 | 110 | 0.16 | 0.13 | 0.13 | " |
| 507 | 103 | 103 | 97 | 0.16 | 0.14 | 0.13 | " |
| 508 | 103 | 103 | 103 | 0.16 | 0.14 | 0.14 | " |
| 509 | 99 | 103 | 105 | 0.16 | 0.14 | 0.14 | " |

TABLE 8

CR-1

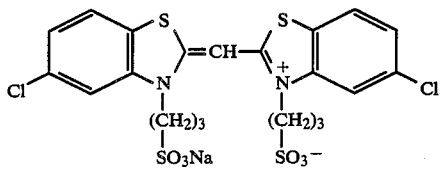

CR-2

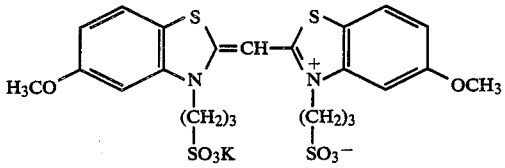

CR-3

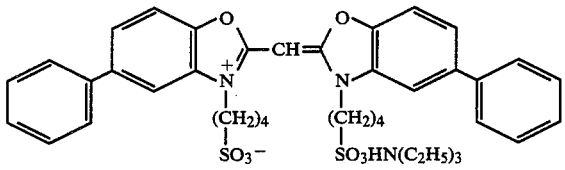

CR-4

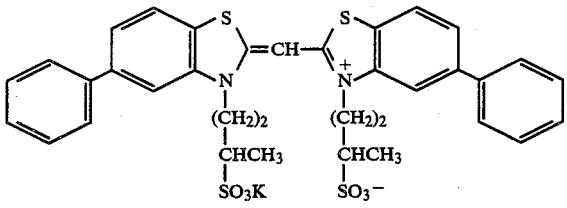

CR-5

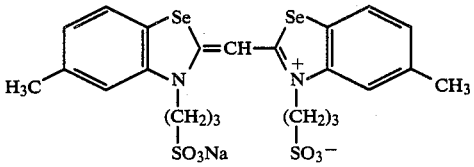

-continued
TABLE 8
CR-6
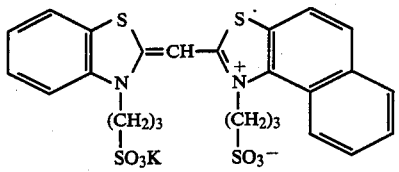
CR-7
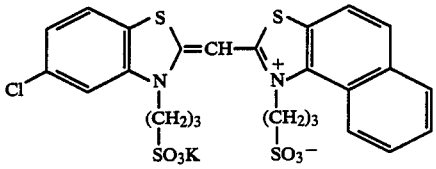
CR-8
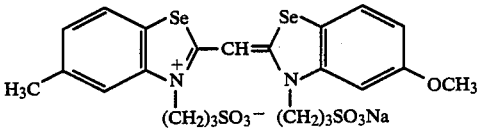
CR-9
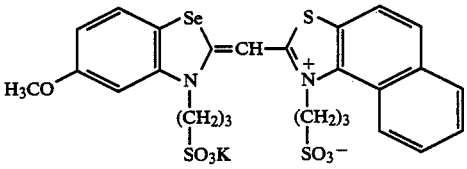
CR-10
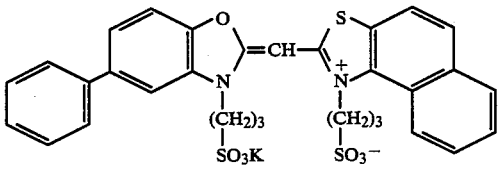
CR-11
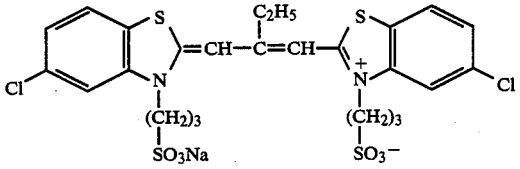
CR-12
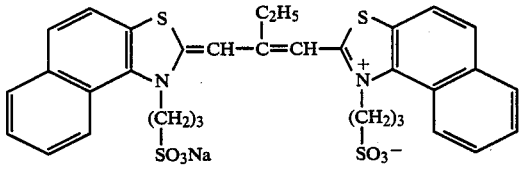
CR-13
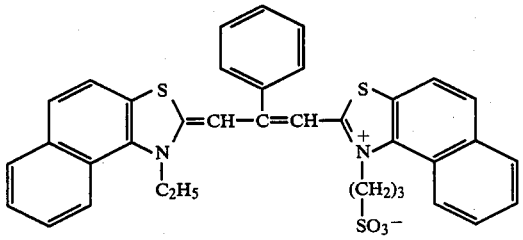

-continued
TABLE 8
CR-14
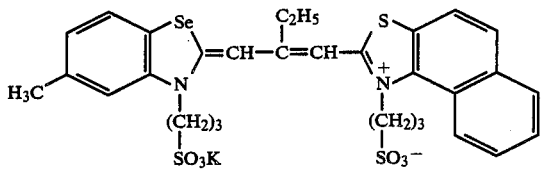
CR-15
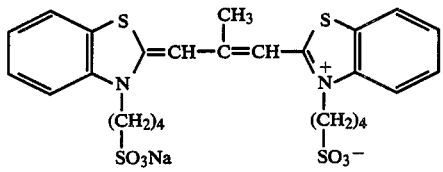
CR-16
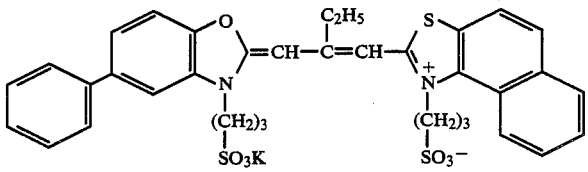
CR-17
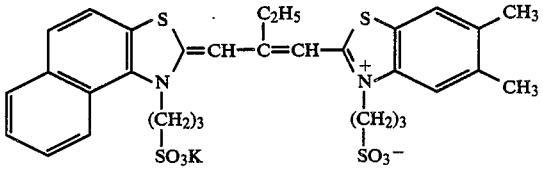
CR-18
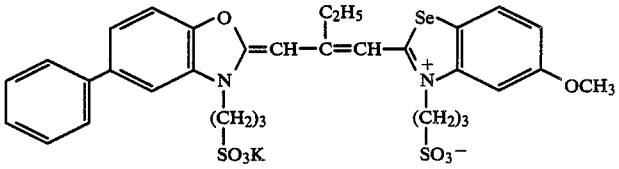
CR-19
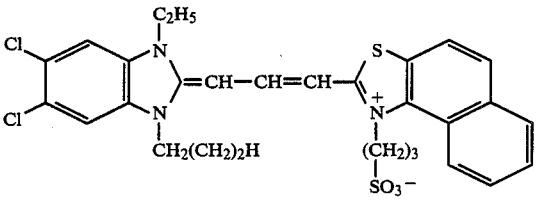
CR-20
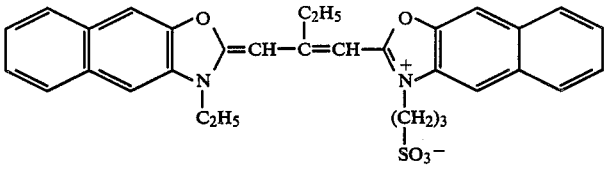
CR-21
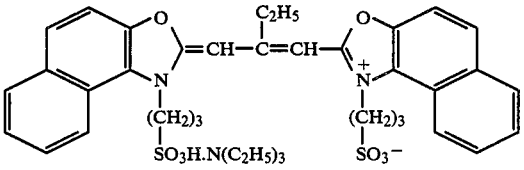

-continued
TABLE 8
CR-22
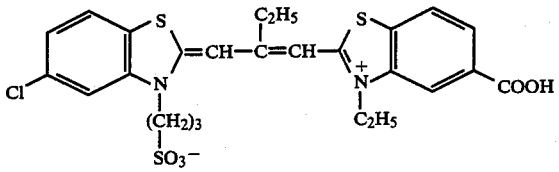
CR-23
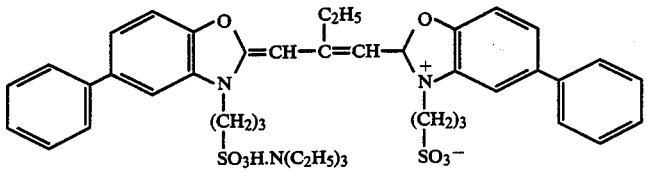
CR-24
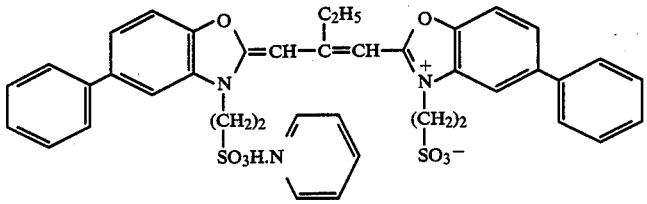
CR-25
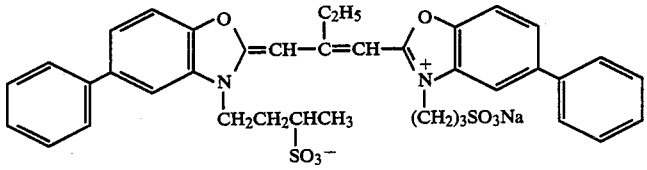
CR-26
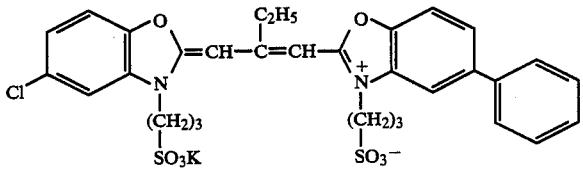
CR-27
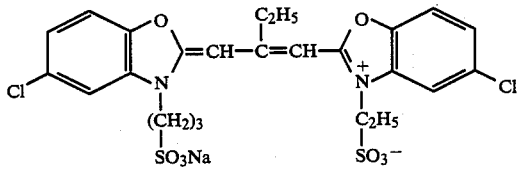
CR-28
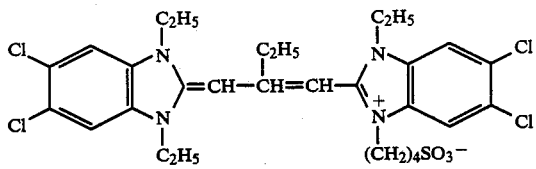
CR-29
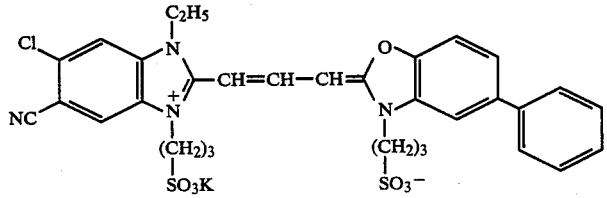

-continued
TABLE 8
CR-30
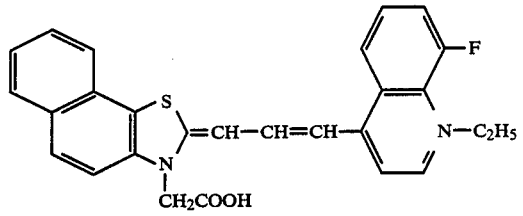
CR-31
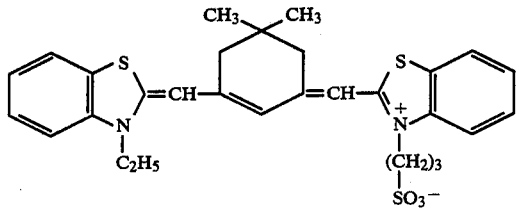
CR-32
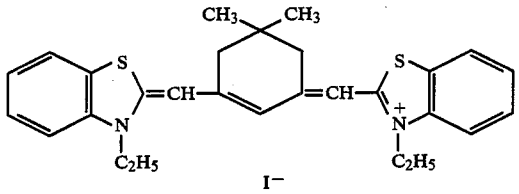
CR-33
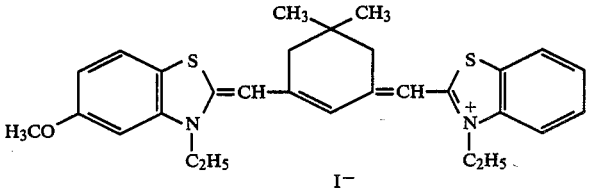
CR-34
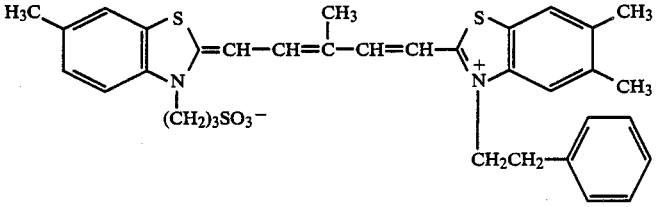
CR-35
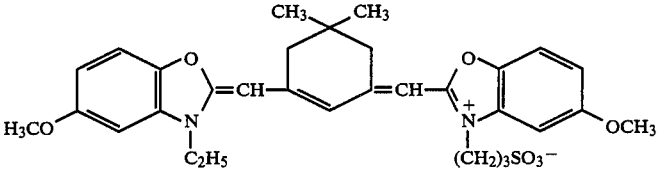
CR-36
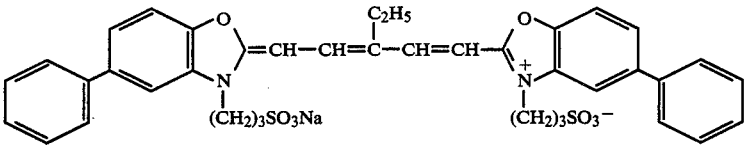
CR-37
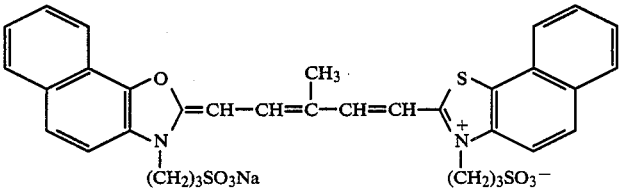

-continued
TABLE 8
CR-38
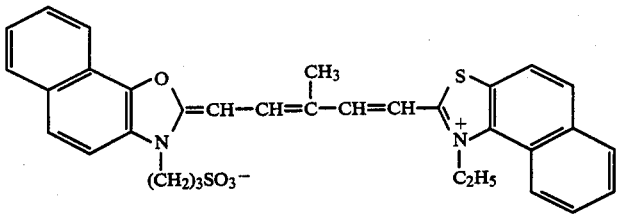
CR-39
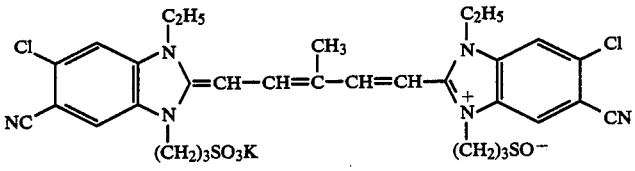
CR-40
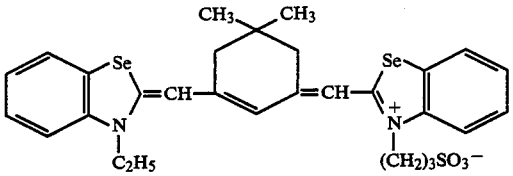
CR-41
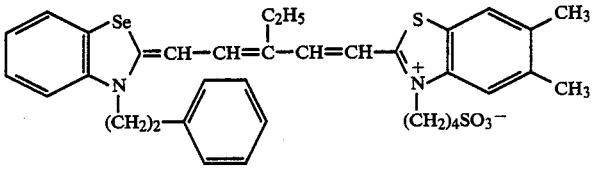
CR-42
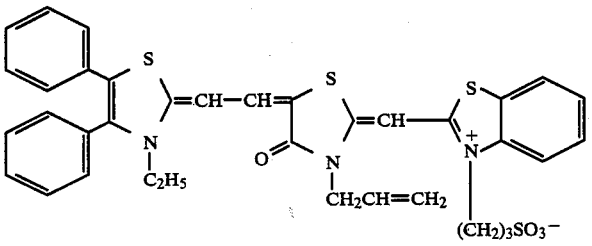
CR-43
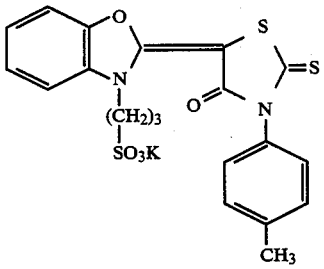
CR-44
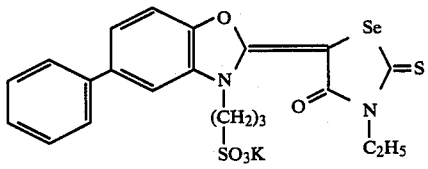

-continued
TABLE 8
CR-45
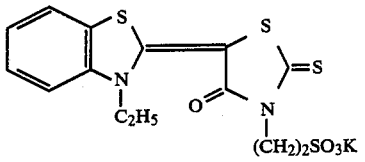
CR-46
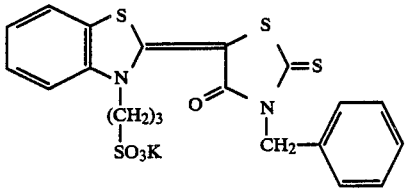
CR-47
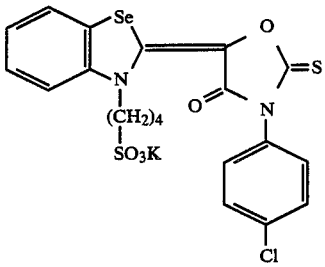
CR-48
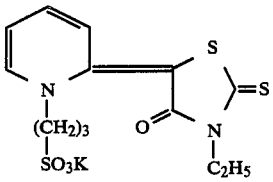
CR-49
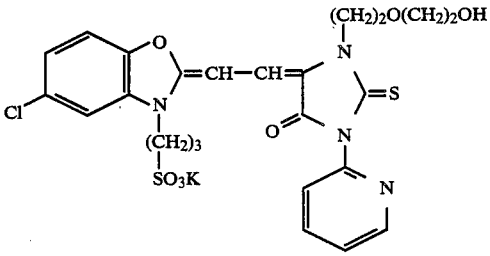
CR-50
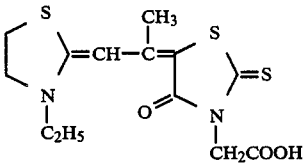
CR-51
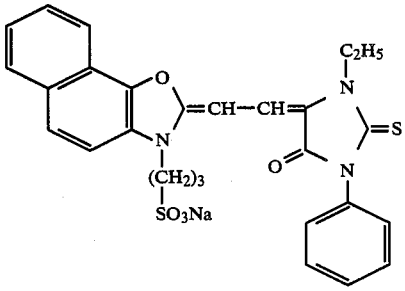

-continued
TABLE 8
CR-52
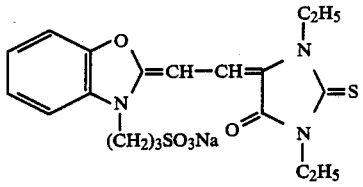
CR-53
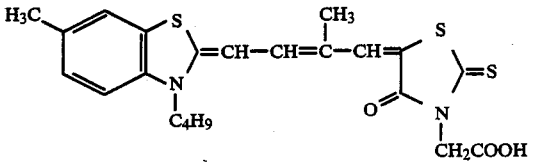
CR-54
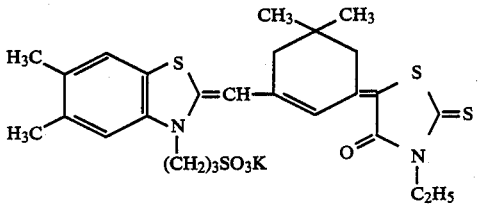
CR-55
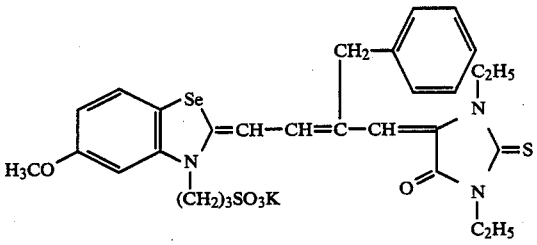
TABLE 9
UV-1
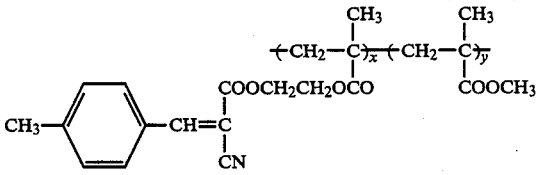
x/y = 7/3 (weight ratio)
UV-2
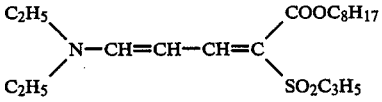
| | |
|---|---|
| Tricresyl Phosphate | Oil-1 |
| Dibutyl Phthalate | Oil-2 |
| Bis(2-ethylhexyl) Phthalate | Oil-3 |

-continued
TABLE 9
C-1
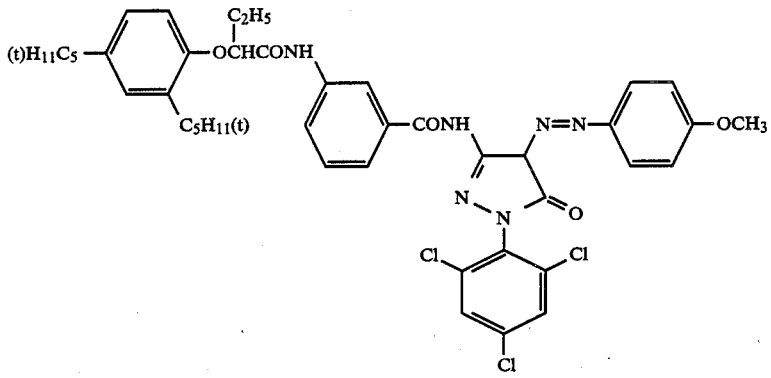
C-2
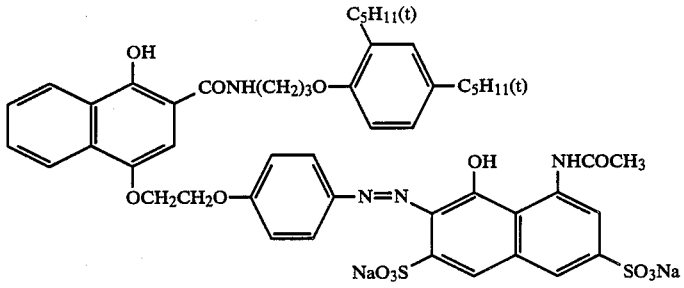
C-3
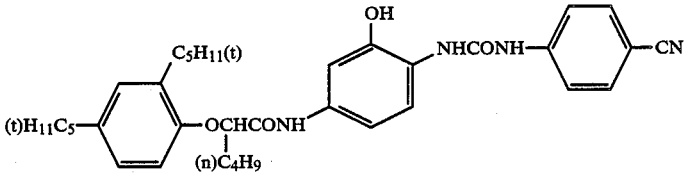
C-4
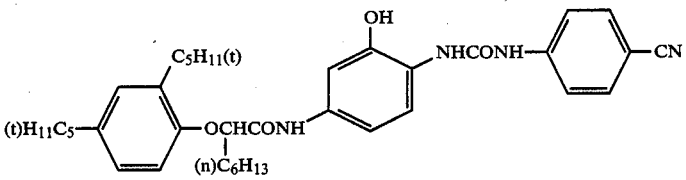
C-5
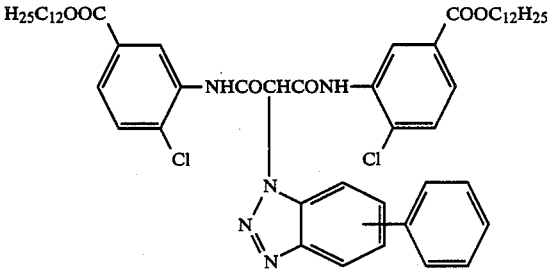

-continued
TABLE 9
C-15
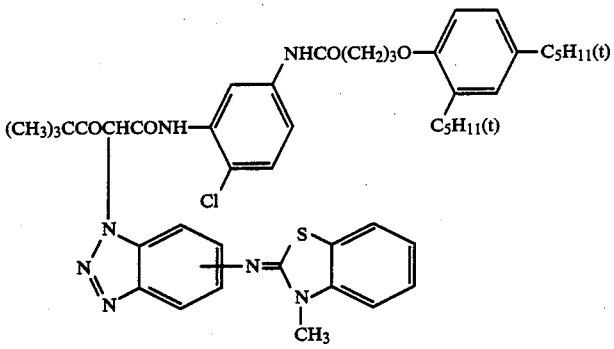
C-6
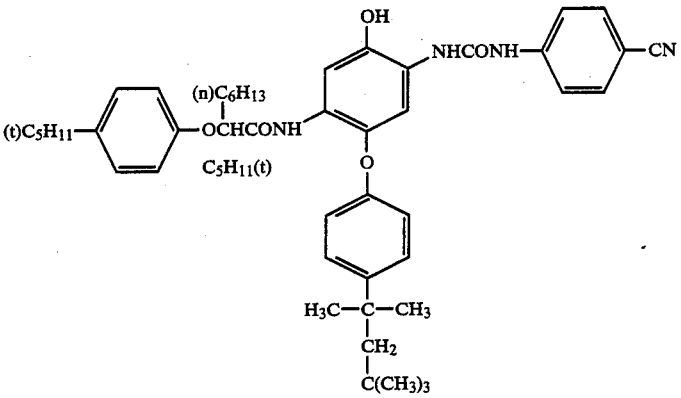
C-7
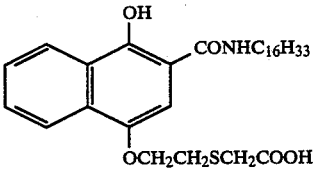
C-8
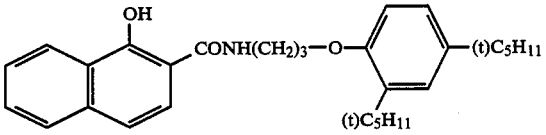
C-9
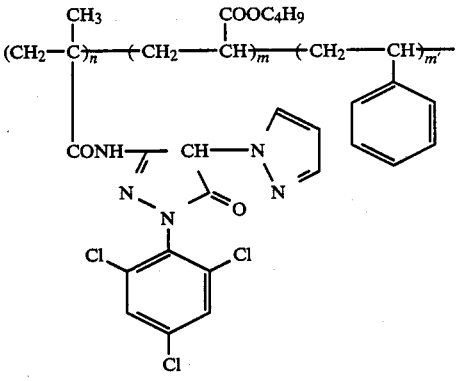
n = 50
m = 25 (weight ratio)
m' = 25
mol.wt.about 20,000

-continued
TABLE 9
C-10
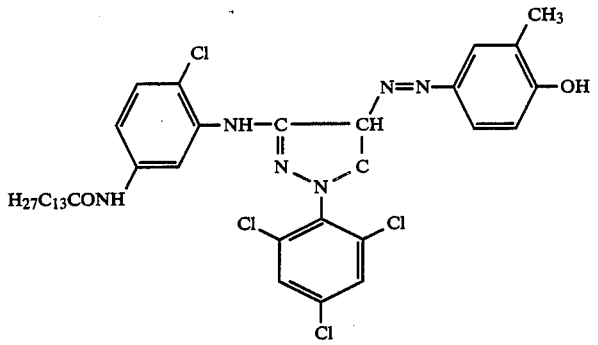
C-11
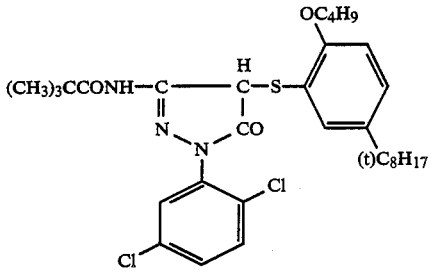
C-12
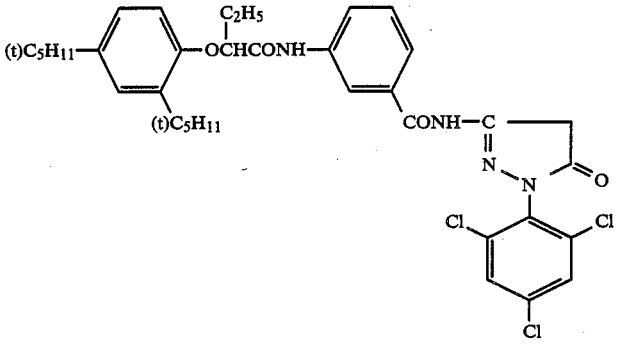
C-13
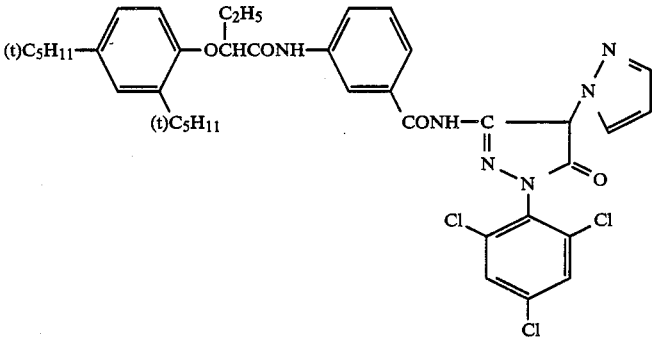
C-14
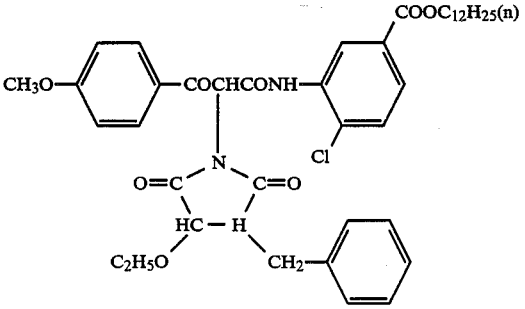

-continued
TABLE 9
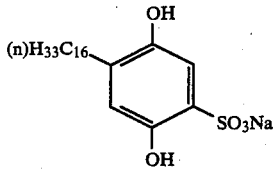
Cpd A
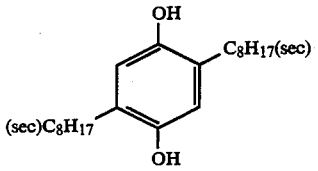
Cpd B
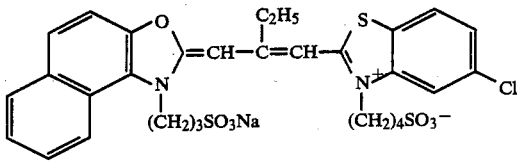
Sensitizing Dye I
The formula is the same as that of the CR-11. — Sensitizing Dye II
The formula is the same as that of the CR-12. — Sensitizing Dye III
The formula is the same as that of the CR-24. — Sensitizing Dye IV
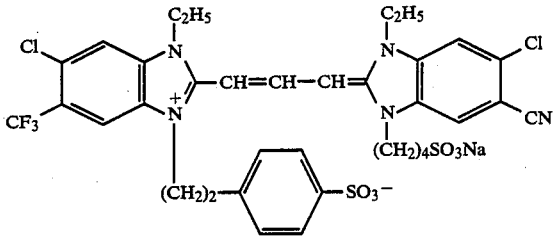
Sensitizing Dye V
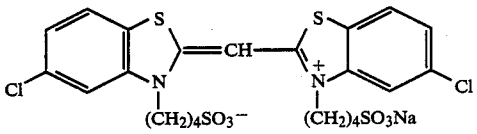
Sensitizing Dye VI
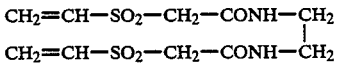
H-1
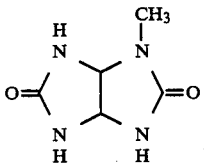
S-1
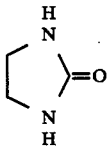
S-2
TABLE 13
Yellow Coupler -continued
TABLE 13
(ExY)
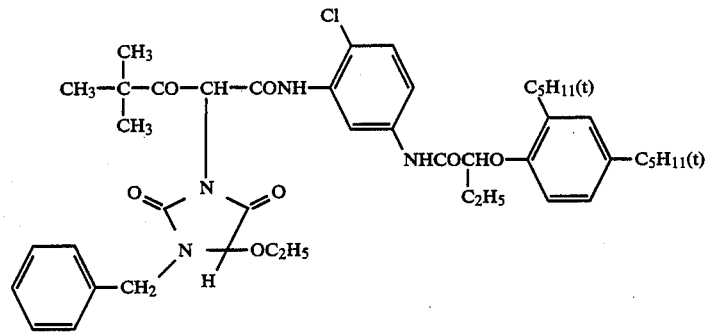
Magenta Coupler
(ExM1)
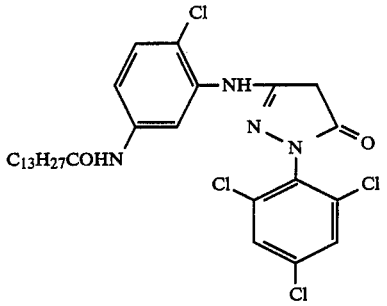
(ExM2)
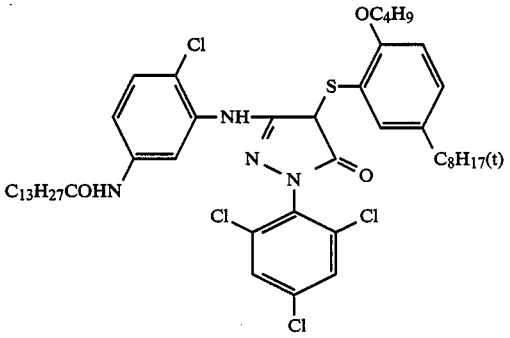
(ExM3)
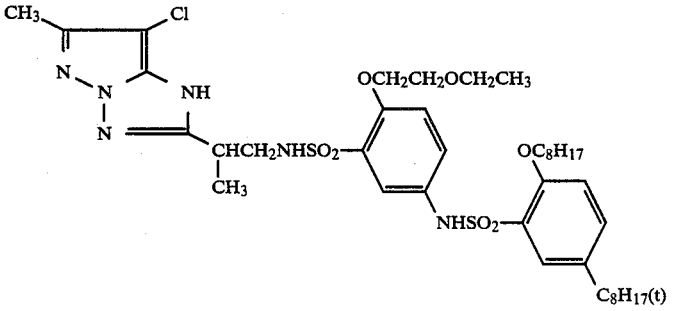

-continued
TABLE 13
(ExM4)
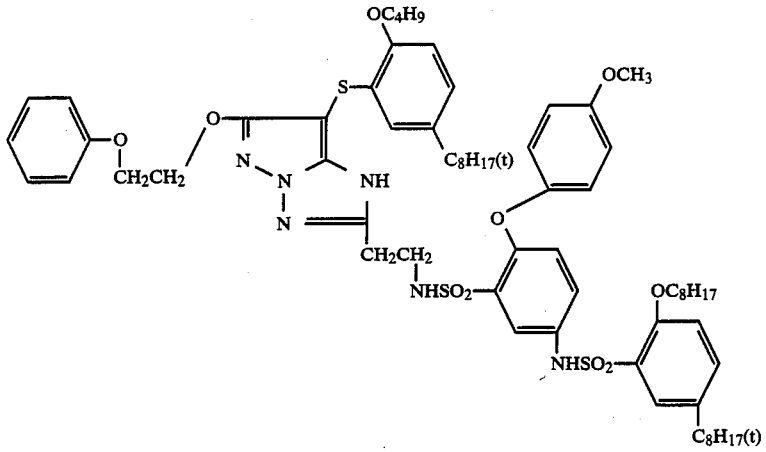
Cyan Coupler
(ExCl)
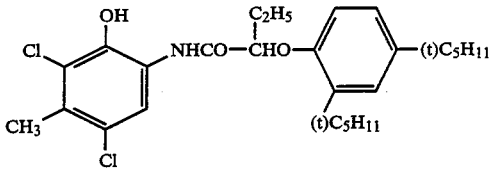
(ExC2)
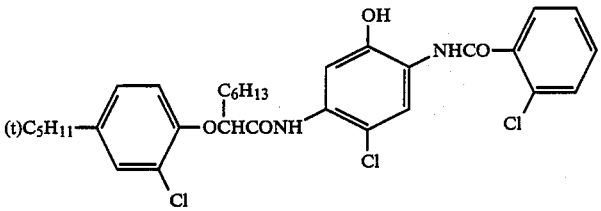
(ExC3)
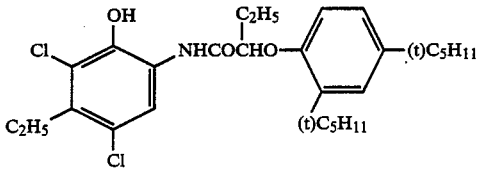
(ExC4)
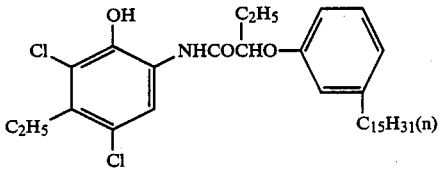
(ExC5)
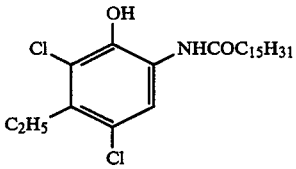
(Cpd-1) Color Image Stabilizer
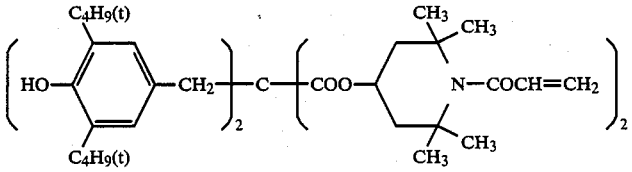

-continued
TABLE 13
(Cpd-2) Color Mixing Preventative Agent
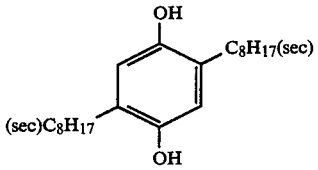
(Cpd-5) Color Mixing Preventative Agent
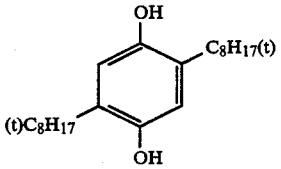
(Cpd-6) Color Image Stabilizer
5:8:9 Mixture (weight ratio) of:
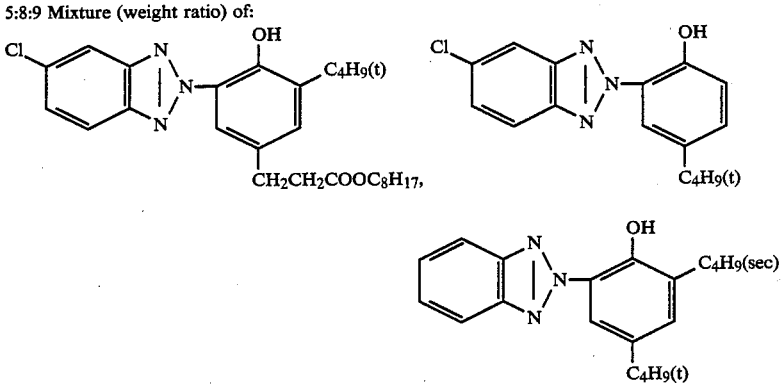
(Cpd-7) Polymer
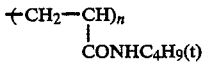
Average Molecular Weight 80,000
(UV-1)
2:9:8 Mixture (weight ratio) of:
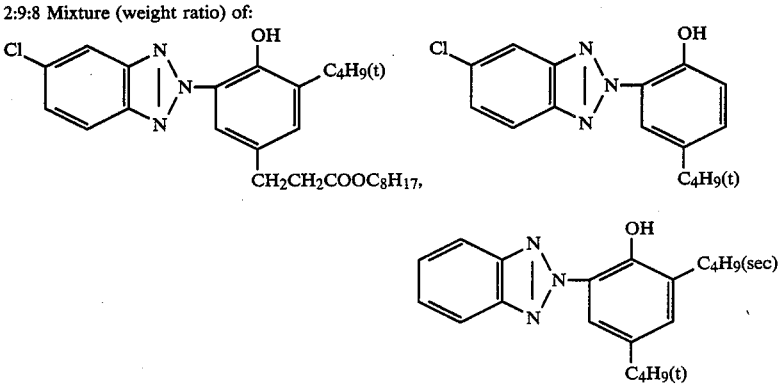
(Solv-1) Solvent
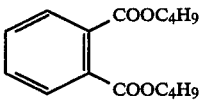
(Solv-3) Solvent
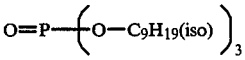
(Solv-4) Solvent
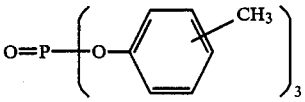

-continued
TABLE 13
Compound Ex-3a
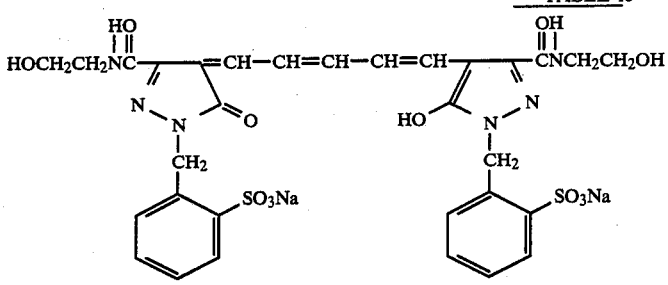
Compound Ex-3b
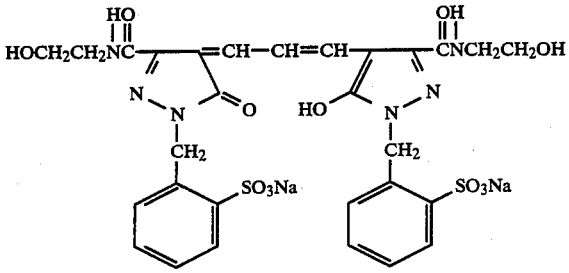
Compound Ex-3c
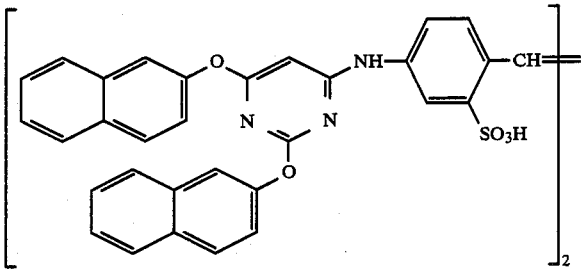
Compound Ex-3d
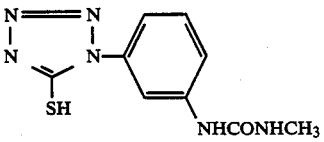
Ex Dye B
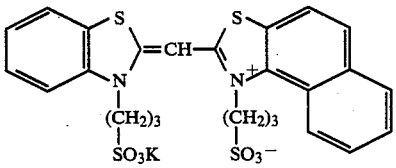
Ex Dye G
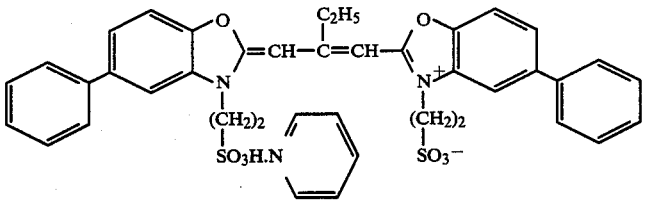
Ex Dye R
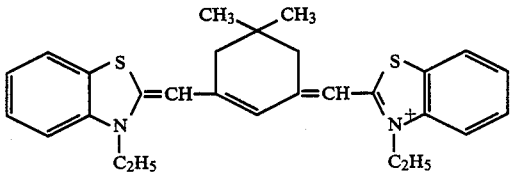
$I^-$ -continued

TABLE 13

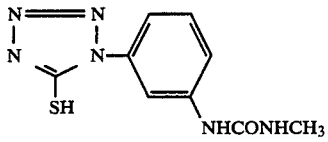

XXI-(7)

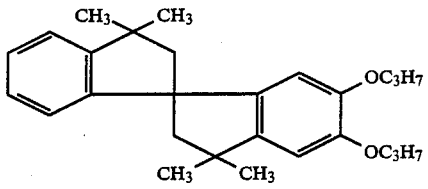

(Cpd-3) Color Image Stabilizer

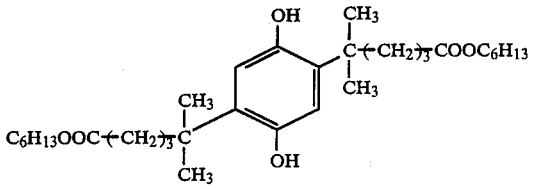

(Cpd-4) Color Image Stabilizer

1:1 Mixture (volume ratio) of:

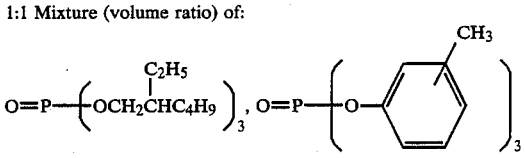

(Solv-2) Solvent

What is claimed is:

1. A photographic light-sensitive material comprising a support having thereon at least one light-sensitive silver halide emulsion layer, characterized in that the emulsion layer contains silver chlorobromide grains prepared in such a manner that the silver halide regular crystal grains, having no twinning crystal plane and containing 50 mol % or more of silver chloride, are used as host grains, an organic compound is adsorbed on a surface of each of the host grains prior to halide conversion, and sulfur-plus-gold sensitization is performed, either during or after halide conversion in the presence of a bromide donor.

2. A photographic light-sensitive material according to claim 1, wherein 50% or more of all silver halide grains contained in the silver halide emulsion layer comprise silver chlorobromide grains prepared by halide conversion in the presence of one member selected from the group consisting of silver chlorobromide grains, silver bromide grains, silver chloroiodobromide grains, an organic halide and a water-soluble bromide, where by the silver chlorobromide grains, the silver bromide grains and the silver chloriodobromide grains are of a size smaller than that of the host grains.

3. A photographic light-sensitive material according to claim 1, wherein the regular crystal grains are cubic, tetradecahedral or octahedral crystal grains.

4. A photographic light-sensitive material according to claim 1 wherein the regular grains are cubic or tetradecahedral crystal grains.

5. A photographic light-sensitive material according to claim 1, wherein the silver chlorobromide grains are obtained by means of halide conversion by ripening the regular crystal grains in the presence of silver chlorobromide grains or silver bromide grains, there grains having a larger bromide content and a smaller size than the host grains, and by means of subsequent sulfur-plus-fold sensitization.

6. A photographic light-sensitive material according to claim 1, wherein the adsorptive organic compound is a dye selected from the group consisting of a simple cyanine dye, a carbocyanine dye, and a dye carbocyanine dye.

7. A photographic light-sensitive material according to claim 1, wherein said absorptive organic compound covers 30 to 100% of the total surface of the host grains.

8. A photographic light-sensitive material according to claim 1, further containing at least one coupler selected from the group consisting of a cyan coupler, a magenta coupler, and a yellow coupler.

9. A photographic light-sensitive material according to claim 1, wherein the halide conversion is performed in the presence of fine grains of silver chlorobromide or silver bromide, the fine grains containing 0.1 to 7 mol % of a bromide with respect to total silver halide content of the host grains.

10. A photographic light-sensitive material according to claim 1, wherein silver coverage to be coated on the support per square meter, is about 3 to 10 g.

11. A photographic light-sensitive material according to claim 1, including at least two light-sensitive silver halide emulsion layers having subsequently the same spectral sensitivity but different speed.

12. A photographic light-sensitive material according to claim 1, wherein the silver conversion is performed in the presence of silver bromide having an average grain size of about 0.05 to 1 μm.

13. A photographic light-sensitive material according to claim 1, wherein the material substantially does not contain developing-inhibitor-releasing coupler.

14. A photographic light-sensitive material according to claim 1, wherein the host grains contain substantially no silver iodide and 90 mol % or more of silver chloride.

15. A photographic light-sensitive material according to claim 1, further containing at least one polymer coupler.

16. A photographic light-sensitive material according to claim 1, wherein the support is transparent.

17. A photographic light-sensitive material according to claim 1, wherein the material has an ISO sensitivity of 25 or more.

18. A photographic light-sensitive material according to claim 1, wherein the material is a negative photographic light-sensitive material.

19. A method for development-processing according to claim 2, wherein a color developer contains $1\times10^{-3}$ mol/l to $2\times10^{-4}$ mol/l of a water-soluble chloride.

20. A method according to claim 2, wherein a color developer solution contains a color developing agent represented by formula [IV]:

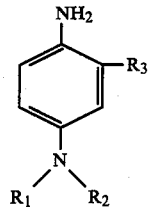

[IV]

wherein $R_1$ represents hydrogen, alkyl, or $R_2$; $R_2$ represents $-(R_4O)_m-(R_5O)_n-R_6$ wherein $R_4$ and $R_5$ each represent the same alkylene or different alkylenes, m and n each represent an integer, 0 to 4, but do not simultaneously represent zero, and $R_6$ represents hydrogen, aryl, or alkyl; and $R_3$ represents hydrogen, halogen, alkyl, hydroxyl, alkoxy, alkylsulfonamido, acylamido, or amino.

21. A method for development-processing according to claim 2, wherein desilvering is performed by a bleach-fixing solution.

22. A method for development-processing a photographic light-sensitive material, comprising:

color-developing said photographic light-sensitive material, said material including a support having thereon at least one light-sensitive silver halide emulsion layer, wherein the emulsion layer contains silver chlorobromide grains prepared in such a manner that silver halide regular crystal grains, having no twinning crystal plane and containing 50 mol % or more of silver chloride, are used as host grains, an organic compound is absorbed on a surface of each of the host grains prior to halide conversion, and sulfur-plus-gold sensitization is performed, either during or after halide conversion in the presence of a bromide donor; and desilvering said color-developed photographic light-sensitizer material.

* * * * *

UNITED STATES PATENT AND TRADEMARK OFFICE

CERTIFICATE OF CORRECTION

PATENT NO. : 4,865,962

DATED : September 12, 1989

INVENTOR(S) : Kazunori Hasebe; Masahiro Asami; Naoto Ohshima; Keisuke Shiba; Toshihiro Nishikawa; Kei Sakanoue; Akira Abe It is certified that error appears in the above-identified patent and that said Letters Patent is hereby corrected as shown below:

Column 69, line 31, delete "claim 2," and insert --claim 22,--;
line 35, delete "claim 2," and insert --claim 22,--.

Column 70, line 21, delete "claim 2," and insert --claim 22,--.

Signed and Sealed this

Fourteenth Day of May, 1991

*Attest:*

*Attesting Officer*

HARRY F. MANBECK, JR.

*Commissioner of Patents and Trademarks*